US006023816A

United States Patent [19]

Okada et al.

[11] Patent Number: 6,023,816

[45] Date of Patent: Feb. 15, 2000

[54] LOCKING DEVICE OF A BUCKLE OF BELT-SHAPED ORNAMENT

[75] Inventors: Kimio Okada; Norio Hashimoto, both of Tanashi, Japan

[73] Assignee: Citizen Watch Co., Ltd., Tokyo, Japan

[21] Appl. No.: 09/147,274

[22] PCT Filed: Mar. 31, 1998

[86] PCT No.: PCT/JP98/01468

§ 371 Date: Nov. 18, 1998

§ 102(e) Date: Nov. 18, 1998

[87] PCT Pub. No.: WO98/43508

PCT Pub. Date: Oct. 8, 1998

[30] Foreign Application Priority Data

Mar. 31, 1997 [JP] Japan ..... 9-079840
Jan. 30, 1998 [JP] Japan ..... 10-018915

[51] Int. Cl.[7] ..... A43C 11/00

[52] U.S. Cl. ..... 24/71 J; 24/68 J; 24/265 WS; 24/58.3

[58] Field of Search ..... 24/71 J, 68 J, 24/70 J, 265 WS, 583, 584

[56] References Cited

U.S. PATENT DOCUMENTS 2,532,840 12/1950 Gaun ..... 24/71 J
4,928,359 5/1990 Gagnebin ..... 24/71 J
5,305,503 4/1994 Yamagata ..... 24/68 J
5,313,691 5/1994 Hashimoto ..... 24/71 J
5,485,659 1/1996 Kashikie et al. ..... 24/71 J

FOREIGN PATENT DOCUMENTS 8000316 1/1996 Japan .
3030914 8/1996 Japan .
1005374 9/1996 Japan .

*Primary Examiner*—Victor N. Sakran
*Attorney, Agent, or Firm*—Dennison, Meserole, Scheiner & Schultz

[57] ABSTRACT

A buckle comprises a pair of push buttons 16 slidably mounted between side walls 4 of a surface cover 2, a spring 19 for outwardly urging the push button, a lock pin 26 mounted on a lower plate 10 and provided to be engaged with a hook of the push button, a lock cover 30 rotatably connected to a connecting pin 14 provided at an end of the lower plate so as to be positioned above the surface cover, and an engaging hole 32 formed in a side wall of the lock cover. An engaging projection 22 of the push button is engaged with the engaging hole so as to lock the lock cover at the closed position.

14 Claims, 23 Drawing Sheets

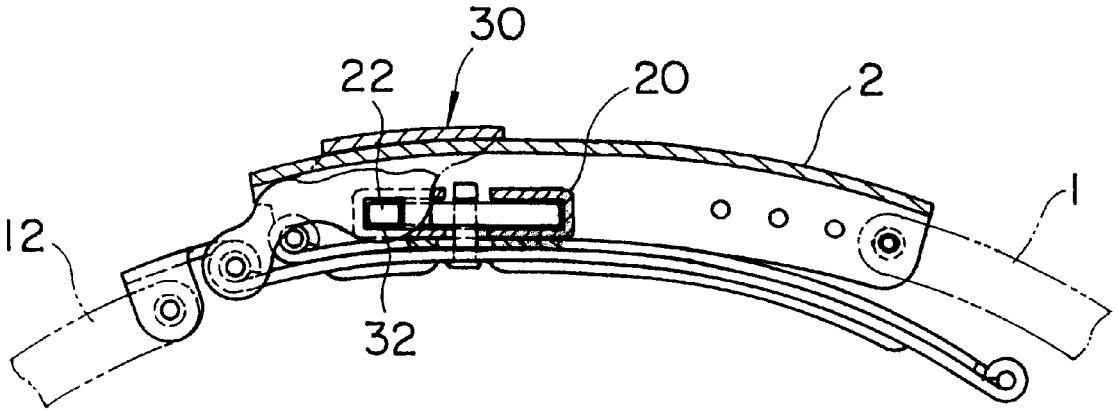
FIG. 8
FIG. 9
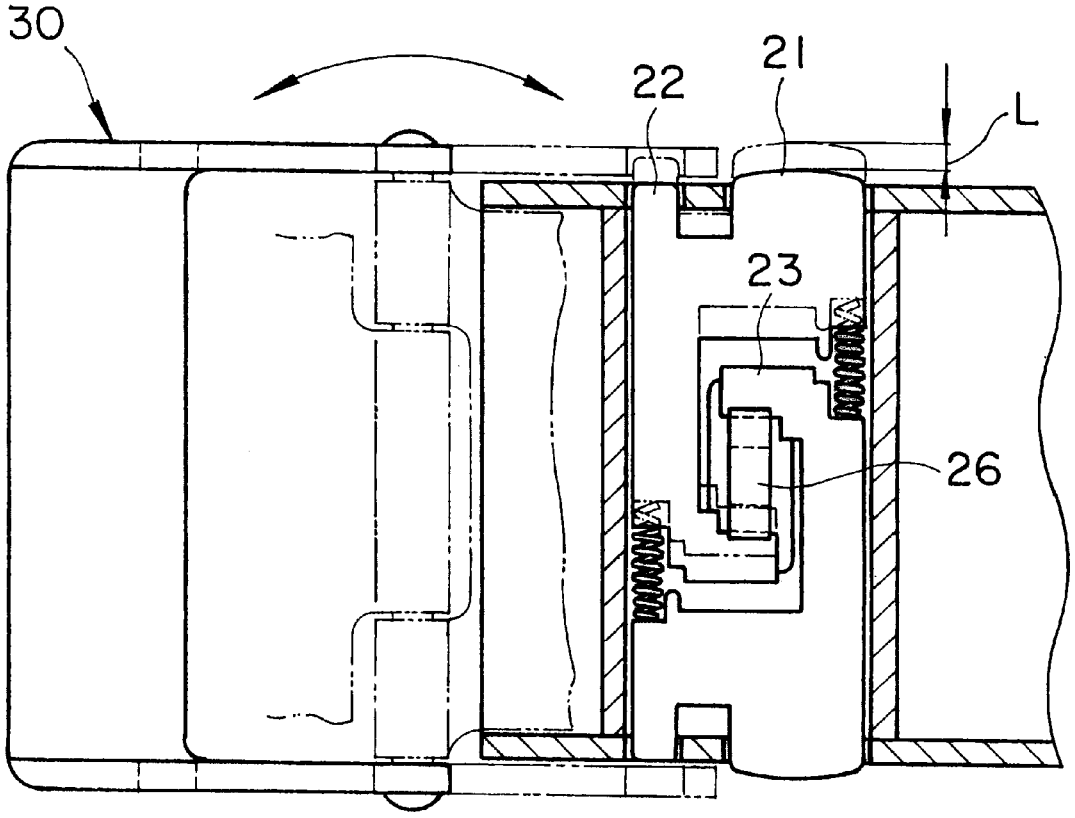

FIG. 10
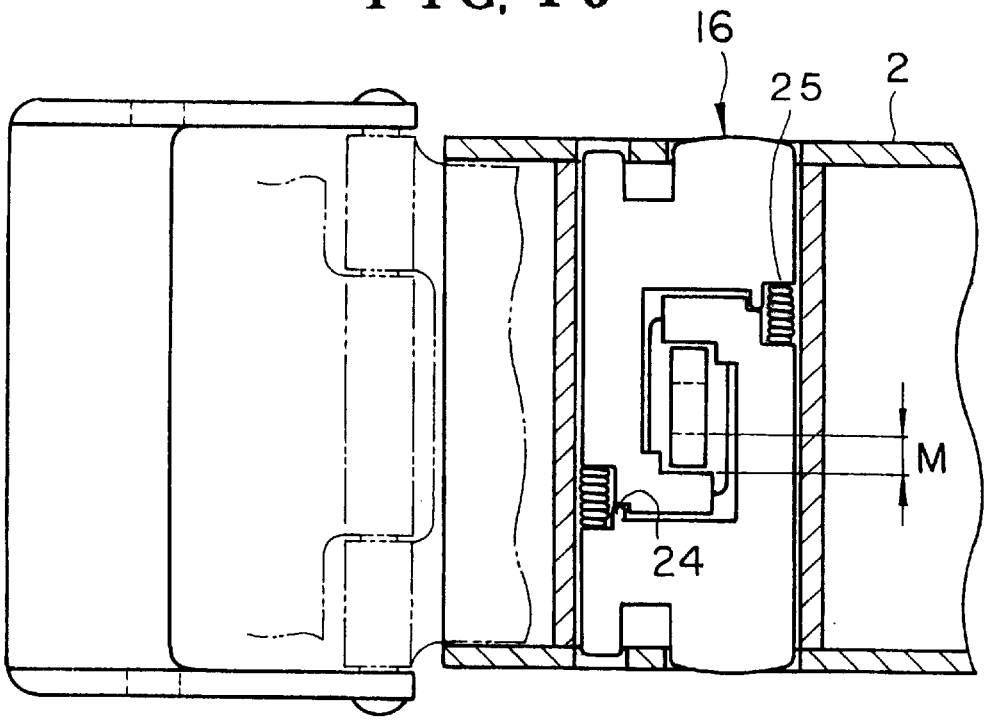
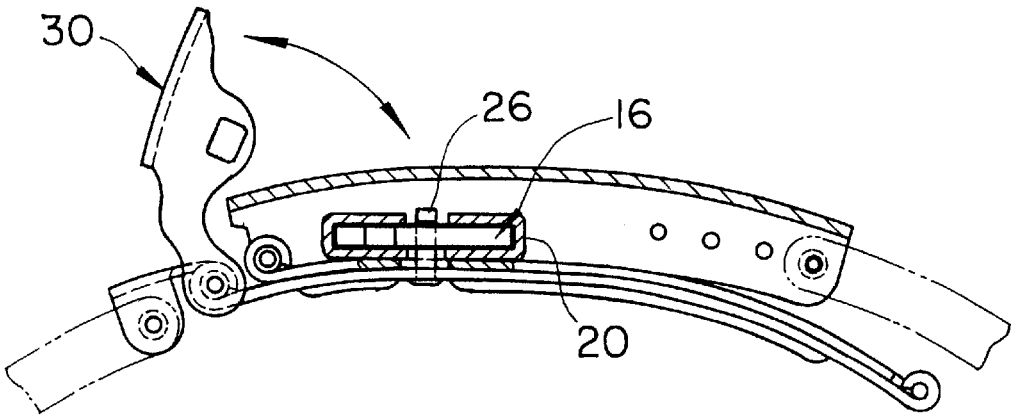
FIG. 11

LOCKING DEVICE OF A BUCKLE OF BELT-SHAPED ORNAMENT

TECHNICAL FIELD

The present invention relates to a lock device for a buckle of a personal adornment band such as a watch band, bracelet and others, and more particularly to a double lock device for a buckle such as a double-folded buckle, triple-folded buckle, opposed buckle which opens like the casement window.

BACKGROUND ART

The triple-folded buckle, for example, has three plates which are pivotally connected with each other. The three plates comprise a lower plate as a base, a middle plate, and a surface cover as a rotating portion.

Japanese Utility Model Laid Open 6-19527 discloses a lock device for the triple-folded buckle. The device has an engaging portion, a pair of push buttons slidably mounted on the underside of a cover so as to be moved in the lateral direction with respect to the longitudinal direction of a band, and a lock pin projected from a lower plate. The buckle is locked by engaging an engaging portion of each push button with the lock pin, and the lock is released by pushing the push button at the same time.

However, there may occur that the push buttons are pushed by a foreign thing so that the buckle is removed. As means for preventing such a trouble, Registered Utility Model 3001890 discloses a double lock device for the triple-folded buckle. The device has a lock cover pivotally mounted on a lower plate. The lock cover is adapted to be engaged with a pin of a spring-loaded pin attached to a surface cover.

Such a device has disadvantages that the number of parts increases due to the spring-loaded pin, which causes the manufacturing cost to increase. There must provide a space necessary for attaching the spring-loaded pin, resulting in enlargement of the buckle and in complication of construction.

An object of the present invention is to provide a lock device resolving the above described problems.

DISCLOSURE OF THE INVENTION

The lock device according to the present invention is characterized by the buckle having a first middle plate operatively connected to an end of a first band, and a lower plate rotatably connected to the first middle plate and operatively connected to a second band, the lock device comprising,a first lock device and a second lock device, wherein the first lock device comprises a guide housing provided in the buckle, at least one push button having an engaging portion and slidably mounted in the guide housing, a spring for outwardly urging the push button, and lock means adapted to be engaged with the push button, and the second lock device comprises a lock cover operatively connected to the lower plate at an end thereof, and engaging means for engaging the lock cover with the push button to hold the lock cover at a closing position.

In an aspect of the present invention, the first middle plate is connected to the first band through a surface cover.

The engaging portion is a hook formed in the push button, and the lock means is a lock pin to be engaged with the hook.

It is preferable to provide a torsion spring provided for urging the lock cover to an open direction.

The engaging portion has an engaging projection, and the lock means is an opening formed in the lower plate so as to be engaged with the engaging projection.

The engaging means comprises an engaging projection formed in the push button and provided to be projected from an opening formed in a side wall of the surface cover, and an engaging hole formed in the lock cover so as to be engaged with the engaging projection.

The engaging projection is provided to be further engaged with an engaging hole formed in the lock cover.

The lock cover may be provided to be released by opening thereof.

The push button may comprise a first push button and a second push button, the engaging projection is formed in the first push button, the lock cover is provided to be released by pushing the first push button.

The push plate may comprise a first push button and a second push button, the engaging projection is formed in the first push button, an engaging plate is formed in the second push button so as to extend in the projecting direction of the engaging projection, the second push button is so provided that the engaging plate is engaged with the engaging hole of the lock cover when pushed.

BRIEF DESCRIPTION OF DRAWINGS

FIG. 8 is a side view showing a lock cover closing state;

FIG. 9 is a sectional plan view showing the operation thereof;

FIG. 10 is a sectional plan view showing the operation;

FIG. 11 is a side view where the lock cover is opened;

BEST MODE FOR EMBODYING THE INVENTION

Figure 1:
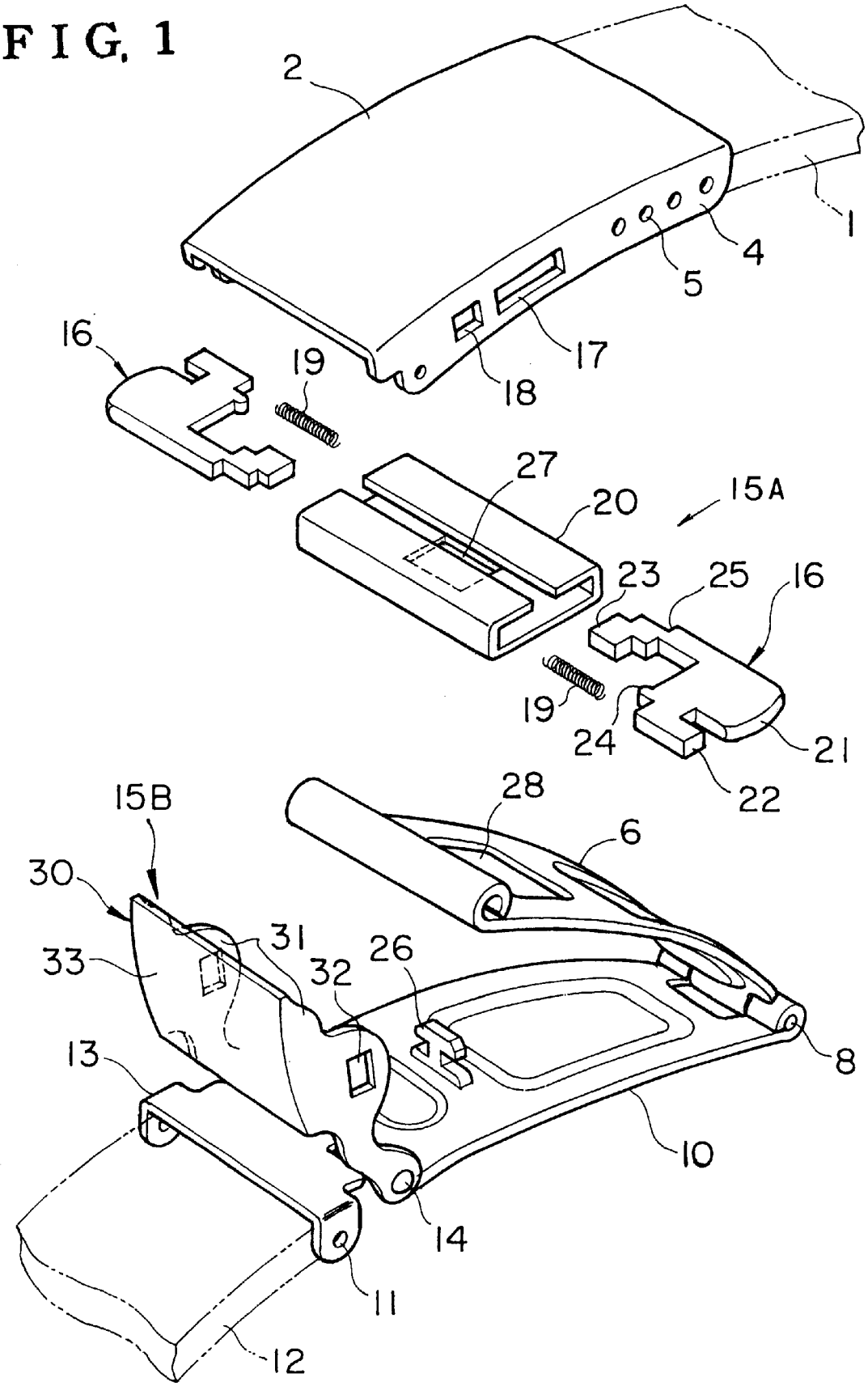
FIG. 1 is an exploded perspective view of a buckle for a band of a watch according to a first embodiment of the present invention.
Figure 2:
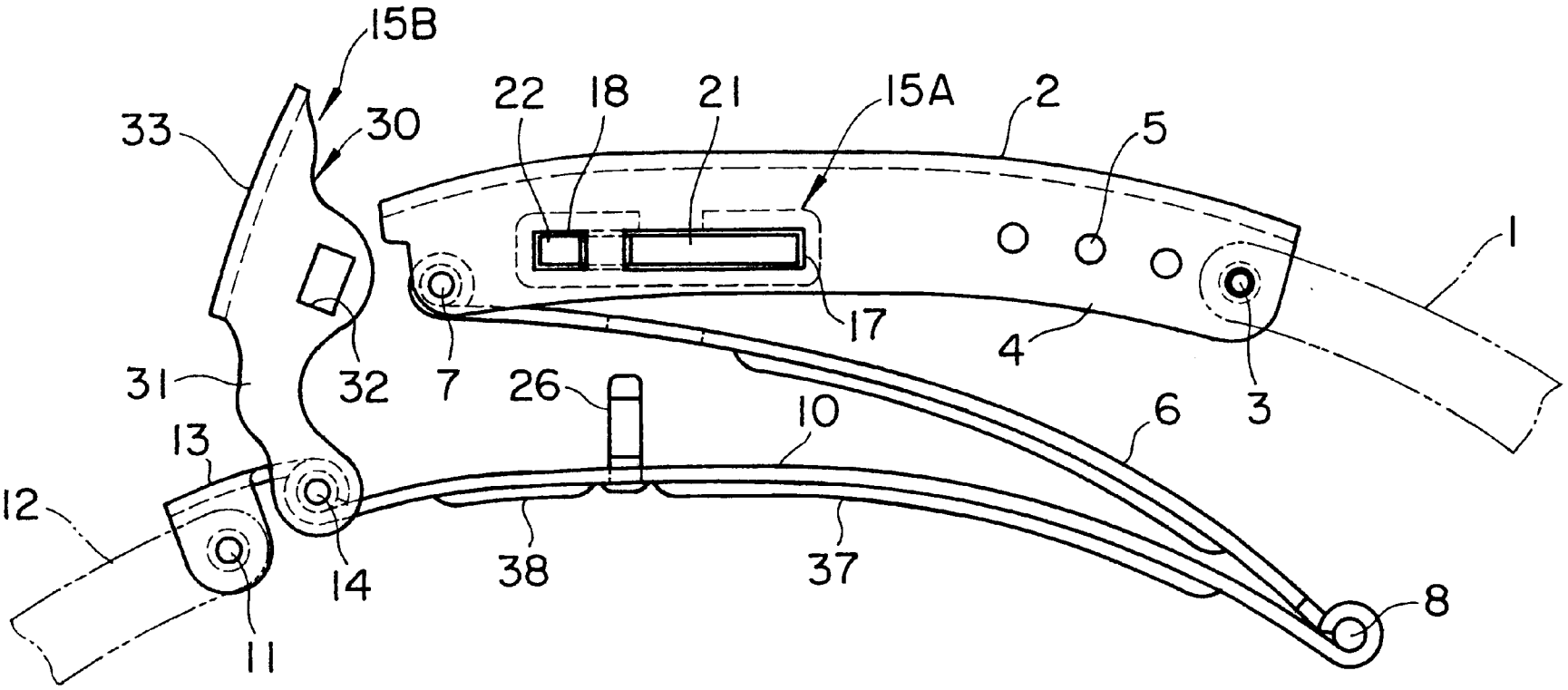
FIG. 2 is a side view thereof.
Figure 3:
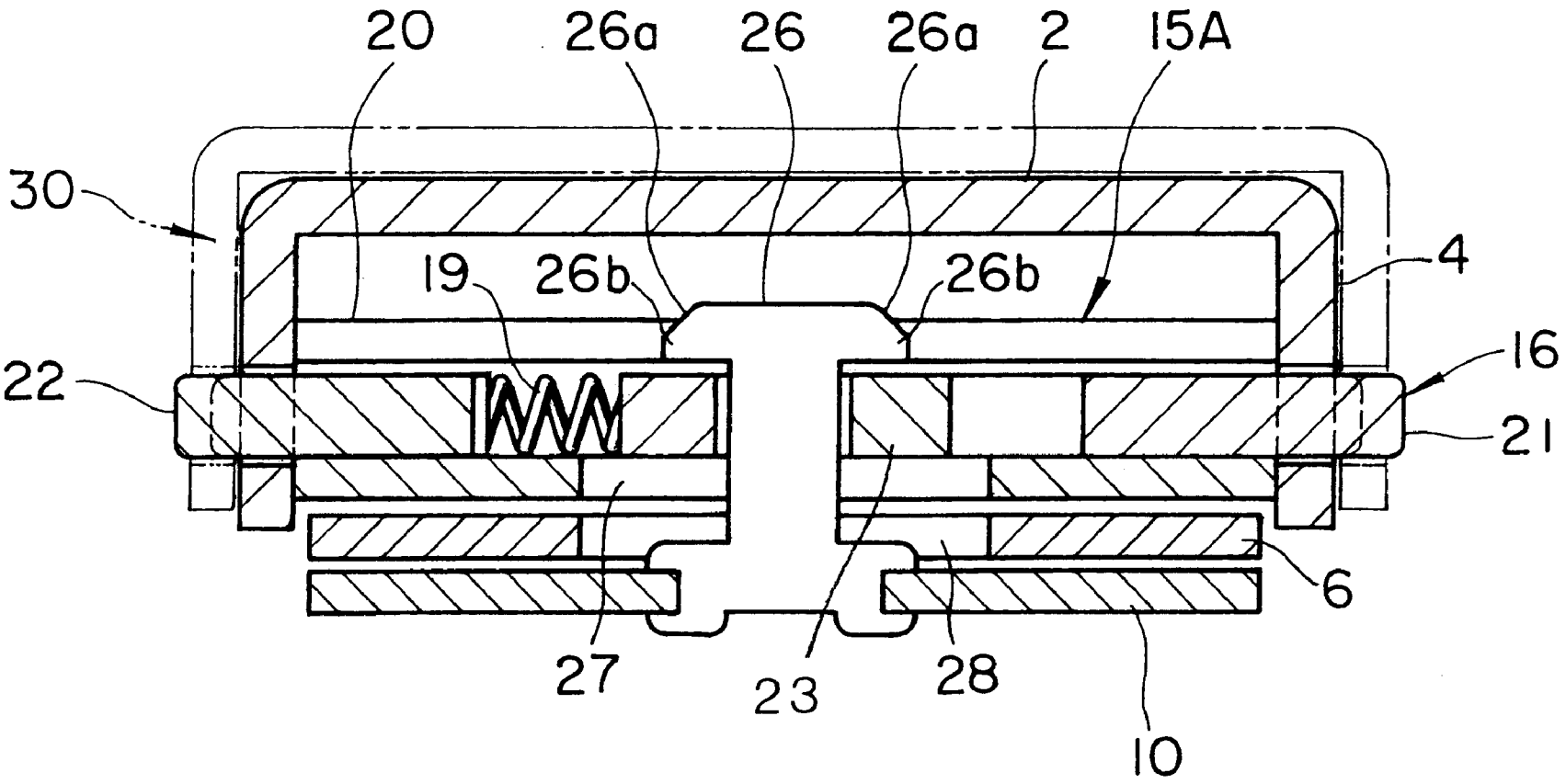
FIG. 3 is a sectional view taken along a line in the lateral direction of a band.
Figure 4:
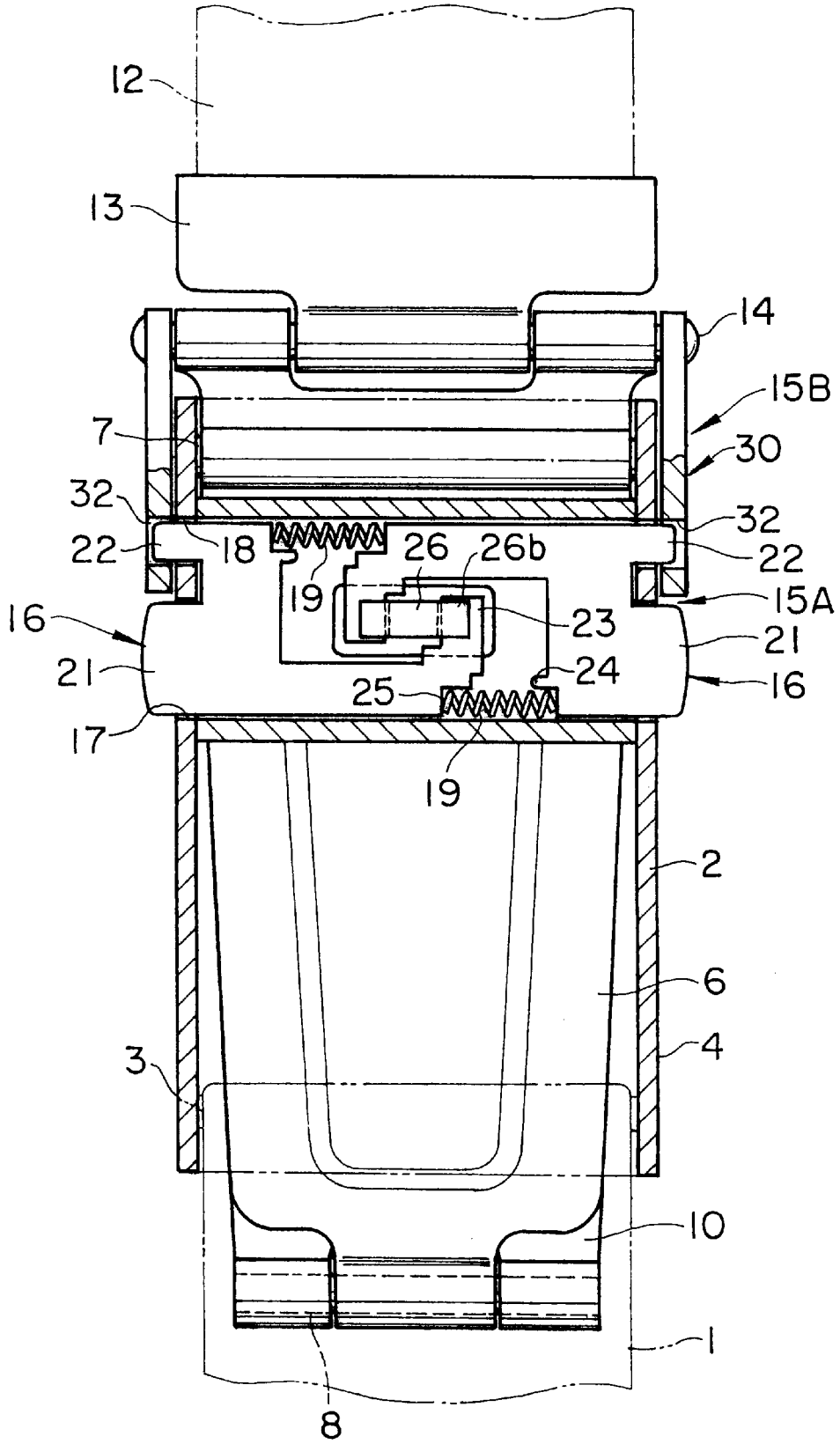
FIG. 4 is a sectional plan view.

FIG. 1 is an exploded perspective view of a buckle for a band of a watch according to a first embodiment of the present invention, FIG. 2 is a side view thereof, FIG. 3 is a sectional view taken along a line in the lateral direction of a band, and FIG. 4 is a sectional plan view.

As shown in the drawings, an end of a surface cover 2 of a buckle is rotatably connected to an end of a band 1 by a spring-loaded pin 3. The spring-loaded pin 3 is adapted to adjust the length of the band by selecting one of attaching holes 5 formed in side walls 4 of the surface cover 2. An end of a middle plate 6 is rotatably connected to the other end of the surface cover 2 by a pin 7. The other end of the middle plate is rotatably connected to an end of a lower plate 10 by a pin 8. The base end of the lower plate 10 is rotatably connected to a connecting plate 13 by a pin 14, which connecting plate is connected to an end of another band 12 by a pin 11, thereby forming an annular band.

In each of the opposite side walls 4 of the surface cover 2, an elongated opening 17 is formed, in which a push button 16 of a first lock device 15A is to be inserted. Adjacent the opening 17, an opening 18 for a second lock device 15B is formed at the middle plate 6 connecting side.

As shown in FIGS. 1 and 4, the first lock device 15A ha s a guide housing 20 having a sectional shape along the periphery of the opening 17, a pair of push buttons 16 slidably inserted in the guide housing 20, and a pair of springs 19 provided between the push buttons 16 so as to outwardly urge the push button respectively. Both the push buttons 16 have the shape of a point symmetry. Each push button 16 has an operating projection 21 projected from the opening 17, an engaging projection 22 projected from the opening 18, an L-shaped hook 23, and a projection 24 and a shoulder 25 for holding the spring 19.

The hook 23 engages with projecting engaging portion 26*b* at opposite sides of a T-shaped lock pin 26 securely mounted on the lower plate 10 as shown in FIG. 3. On the other hand, the guide housing 20 and the middle plate 6 have openings 27 and 28 through which the lock pin 26 passes.

The attachment of the first lock device 15A to the surface cover 2 is performed in such a manner that the guide housing 20 is inserted between the side walls 4 while pushing the push buttons 16, thereafter releasing the push buttons to engage the operating projections 21 and engaging projections with the openings 17 and 18, respectively. In the condition, the guide housing 20 is held by the side walls 4.

In accordance with the present invention, a lock cover 30 of the second lock device 15B is rotatably mounted on the pin 14 connecting the lower plate 10 and the connecting plate 13. In each side wall 31 of the lock cover 30, an engaging hole 32 is formed so that the engaging projection 22 may be engaged therewith.

Figure 5:
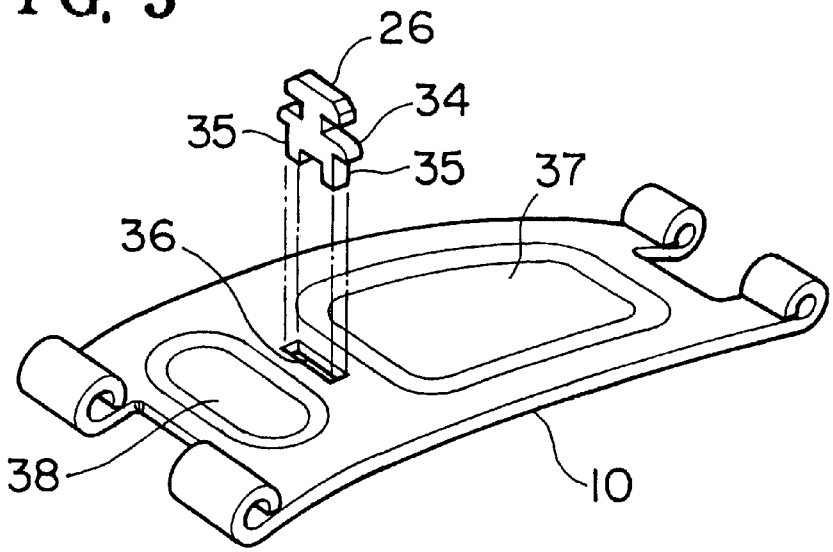
FIG. 5 is a perspective view showing a fixing method of a lock pin.
Figure 6:
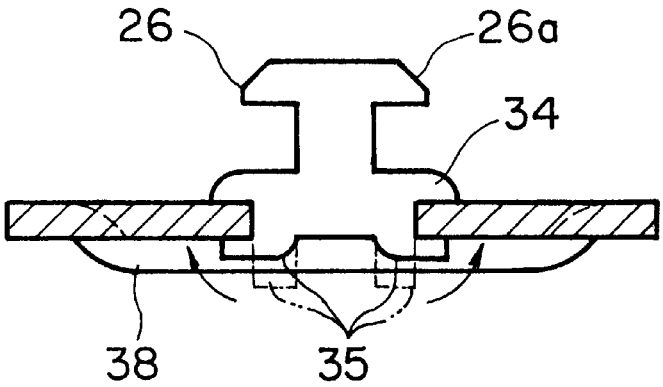
FIG. 6 is a sectional view showing a fixing condition of the lock pin.
Figure 7:
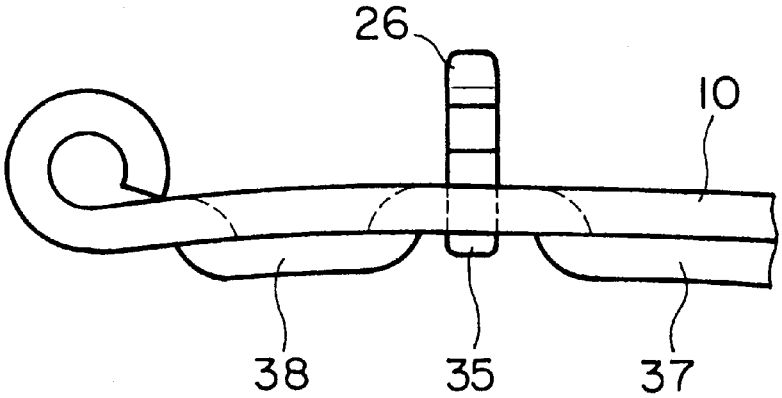
FIG. 7 is a side view showing protecting means for a leg of the lock pin.

As shown in FIG. 5, the lock pin 26 has opposite projections 34 at a lower portion thereof and a pair of legs 35. The legs 35 are inserted in a hole 36 of the lower plate 10 and downwardly projected. As shown in FIG. 6, the legs 35 are bent, so that the lock pin 26 is secured to the lower plate 10 by engagement with the projections 34 and the legs 35. Furthermore, as shown in FIG. 7, a reinforcement rib 37 and a protecting rib 38 formed on the lower plate 10 are provided on both sides of the legs 35 of the lock pin 26. Since the ribs 37 and 38 are higher than the legs 35, the ribs prevent legs 35 from abutting against an arm of a user when wearing the watch.

To wear the watch, the first and the second lock devices 15A and 15B are released as shown in FIG. 2, and the buckle is opened to expand the bands 1 and 12, thereby putting on an arm. Then, the buckle is folded and the surface cover 2 is pushed toward the lower plate 10, so that the underside of each hook 23 of the push button 16 abuts against an inclined surface 26*a* of the lock pin 26. The push button 16 is outwardly moved by the inclined surface 26*a* against the spring 19. When the push button 16 passes the head portion of the lock pin 26, the push button is returned by the spring 19. As shown in FIGS. 3 and 4, the hook 23 of each push button 16 engages with an engaging portion 26*b* of the lock pin 26 to lock the buckle. In this condition, the engaging projection 22 projects slightly from the opening 18 of the surface cover 2.

Next, the lock cover 30 of the second lock device 15B is rotated to the surface cover 2, causing the side walls 31 to contact with the engaging projection 22 of the push button 16 to push the push button against the spring 19. When the engaging hole 32 reaches the engaging projection 22, the projection 22 engages with the hole 32 due to the resilient force of the spring as shown in FIGS. 3 and 4. Thus, the surface cover 2 is locked, the buckle is completely locked. FIG. 8 shows the complete lock condition.

In the first and second lock devices 15A and 15B, when the push buttons 16 are inwardly pushed by the lock cover 30, the engagement of hooks 23 with the lock pin 26 is maintained as shown in FIG. 9. Therefore, there does not occur the trouble that the first lock device 15A is released. More specifically, if the moving distance of the push button 16 is L (FIG. 9) and the engagement length between the hook 23 and the lock pin 26 is M (FIG. 10), there is a relation of M>L.

In order to release the lock, the lock cover 30 is opened (FIG. 11), so that the engaging projection 22 is pushed by the edge of the hole 32, thereby releasing the second lock device 15B. Thereafter, push buttons 16 are pushed as shown in FIG. 10. Thus, the first lock device 15A is released, and the surface cover 2 and the middle plate 6 can be opened.

The projection 24 and the shoulder 25 guide the spring 19 and prevent the spring from snaking, while compressing, when the push button 16 is pushed, the tip of the projection 24 strikes on an end face of the opposite push plate as shown in FIG. 10, thereby determining the stroke M.

Figure 12:
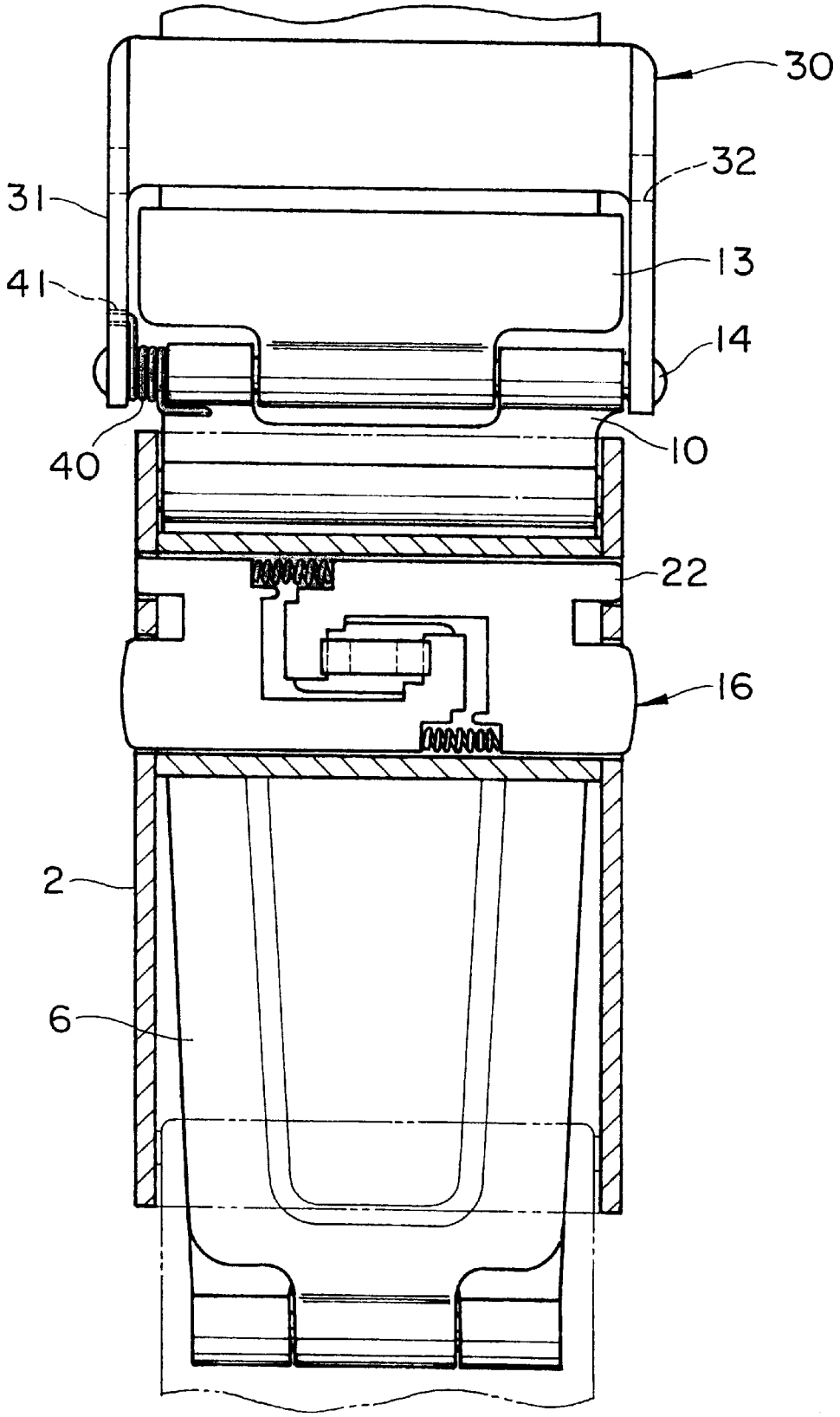
FIG. 12 is a sectional plan view showing a second embodiment of the present invention.
Figure 13:
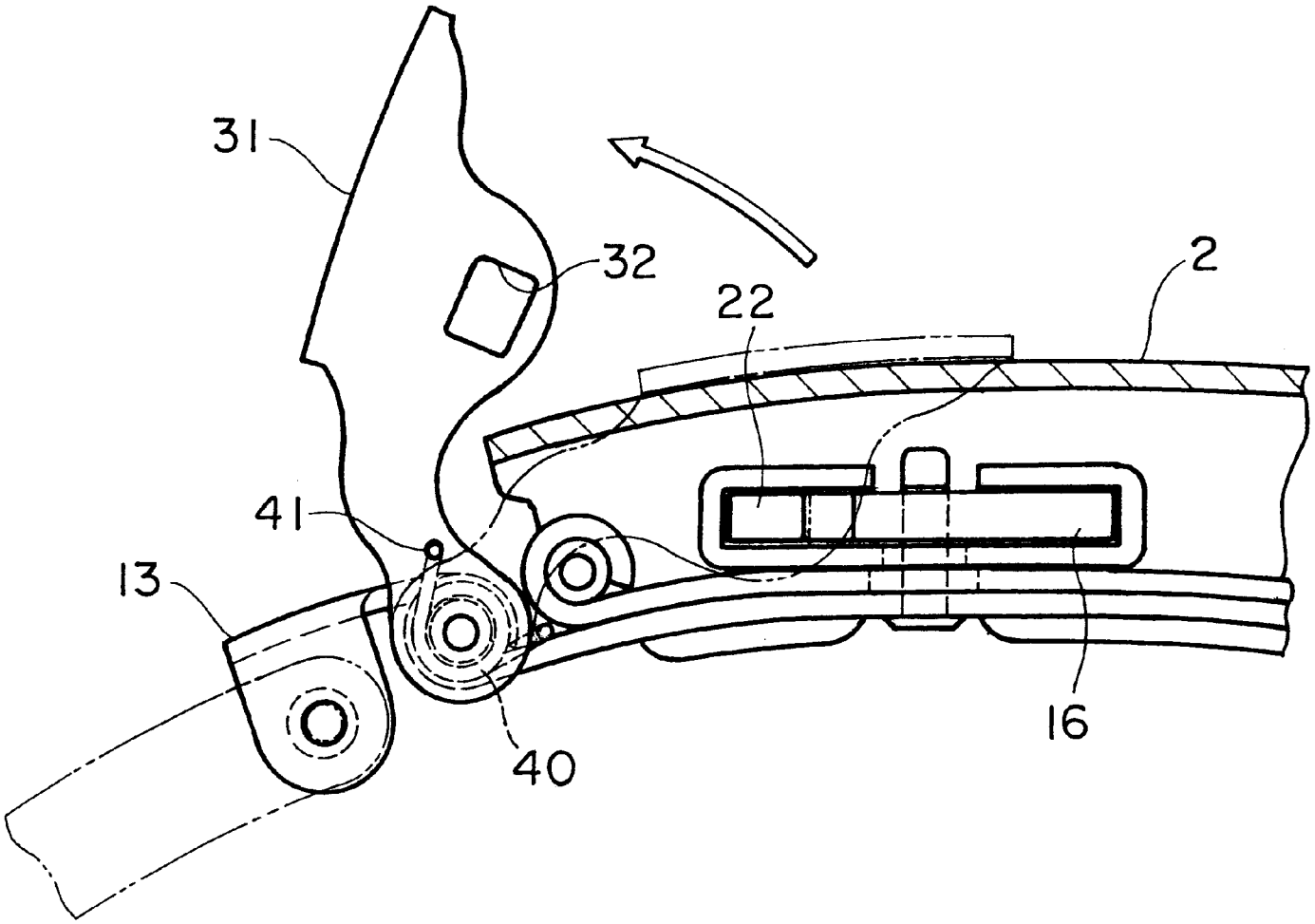
FIG. 13 is a sectional side view thereof.

FIGS. 12 and 13 show the second embodiment of the present invention. The same parts as the first embodiment are identified by the same reference numerals thereof, so that the explanation of the parts is omitted.

In the embodiment, a torsion spring 40 is mounted on the connection pin 14 between the lower plate 10 and the connecting plate 13. One of the ends of the spring 40 is engaged with a hole 41 formed in the side plate 31 of the lock cover 30, and the other end of the spring is pressed against the surface of the lower plate 10, thereby urging the lock cover to the opening direction.

Therefore, when the push buttons 16 are pushed to remove the engaging projection 22 from the engaging hole 32 of the lock cover 30, the lock cover 30 is automatically opened by the torsion spring 40 as shown in FIG. 13.

Thus, in accordance with the embodiment, the operation for opening the lock cover is not necessary, the operation for releasing the lock is simplified.

Figure 14:
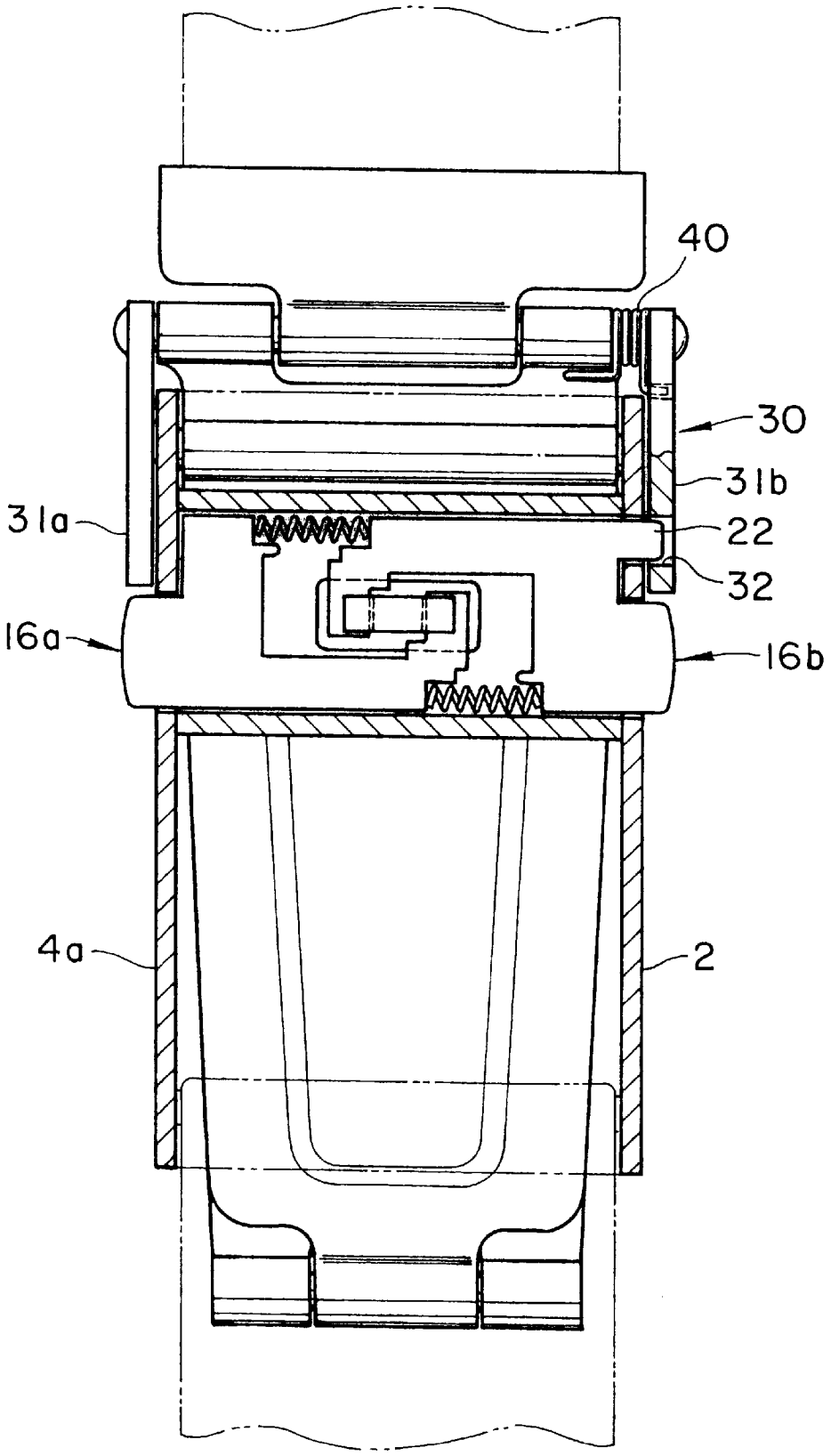
FIG. 14 is a sectional plan view of a third embodiment of the present invention.

FIG. 14 shows the third embodiment of the present invention. The embodiment is an improvement of the second embodiment. There is not provided with the engaging projection 22 on a push button 16*a*, hence a side wall 4*a* of the surface cover 2 has not the opening 18, and the engaging hole 32 is not formed in a side wall 31*a* of the lock cover 30.

Therefore, if the push button 16*a* only is pushed, the lock cover 30 can not be opened. By pushing only the other push button 16*b* or both push buttons 16*a* and 16*b*, the lock cover 30 is opened by the spring 40.

When both push buttons are pushed, the push button 16*a* is vainly moved. However, the pushing of both push buttons is easier than the pushing only one push button.

Figure 15:
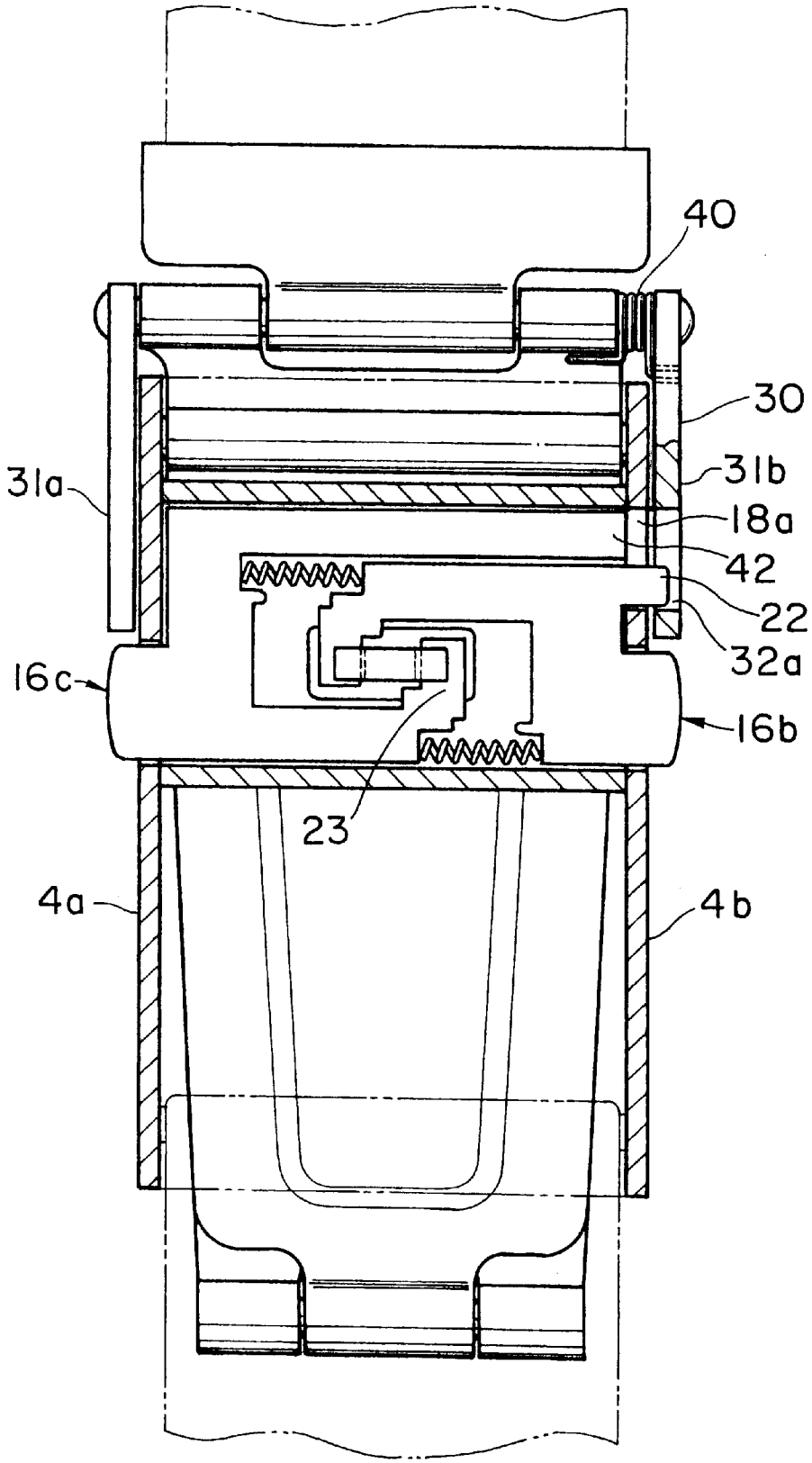
FIG. 15 is a sectional plan view of a fourth embodiment of the present invention.

FIG. 15 shows the fourth embodiment of the present invention. Although the push button 16*b* is the same as the third embodiment, another push button 16*c* has not the engaging projection 22. Instead, an inwardly extending elongated engaging plate 42 is provided on the opposite side to the hook 23. On the other hand, an opening 18*a* of a side wall 4*b* of the surface cover 2 and an engaging hole 32*a* of a side wall 31*b* of the lock cover 30 are elongated so as to receive the engaging plate 42. Furthermore, no holes are formed in the side wall 4*a* and the side wall 31*a*.

Figure 16:
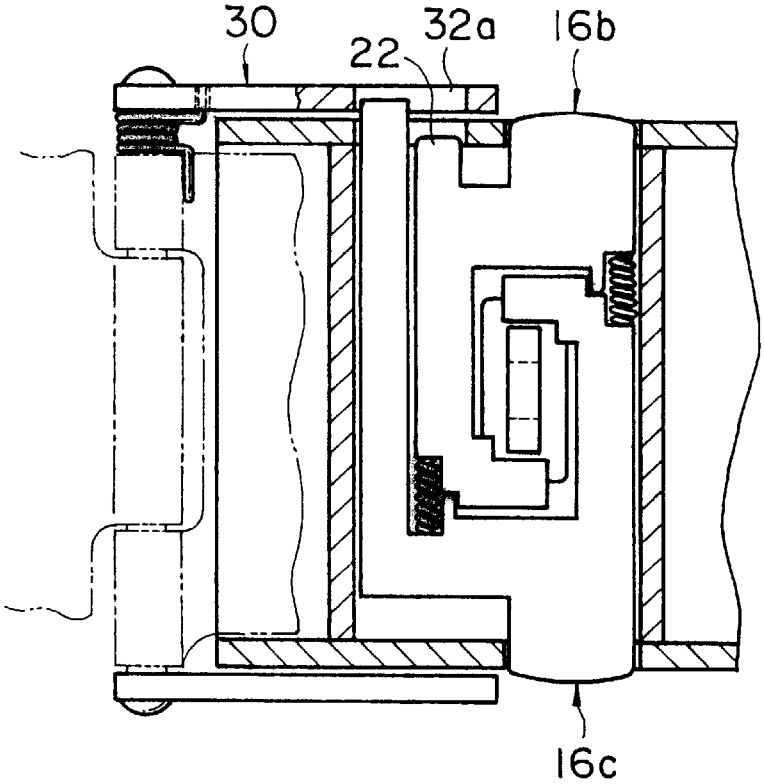
FIG. 16 is a sectional plan view showing the operation thereof.

When push buttons 16*b* and 16*c* are pushed as shown in FIG. 16, the engaging projection 22 is disengaged from the engaging hole 32*a*. However, the engaging plate 42 enters the hole 32*a*, hence the lock cover 30 can not be opened.

Figure 17:
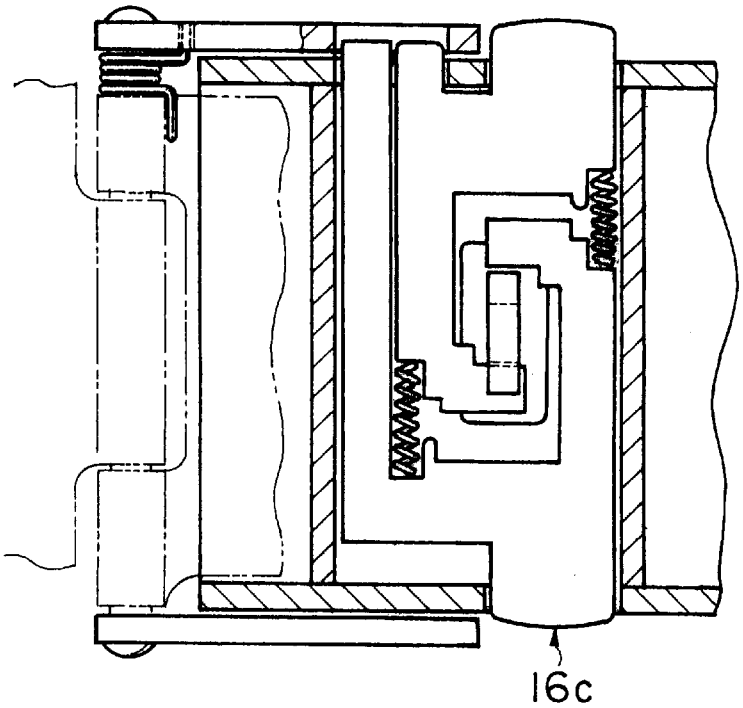
FIG. 17 is a sectional plan view showing the operation.

If only the push button 16*c* is pushed as shown in FIG. 17, the lock cover cannot be opened.

Figure 18:
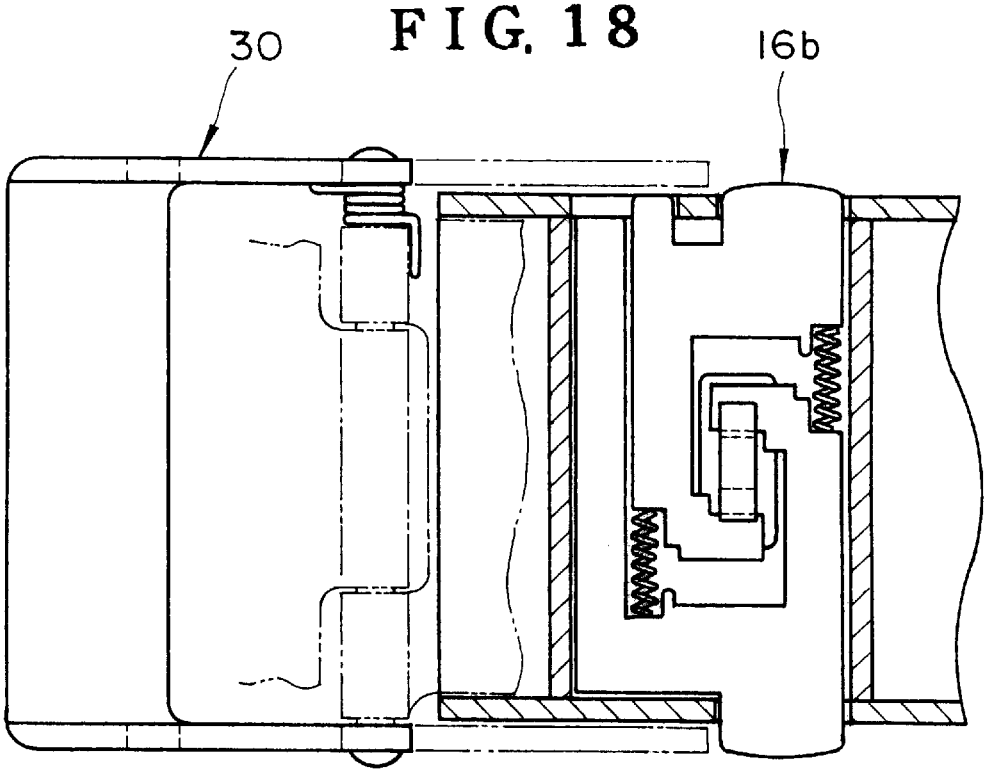
FIG. 18 is a sectional plan view showing the operation.
Figure 19:
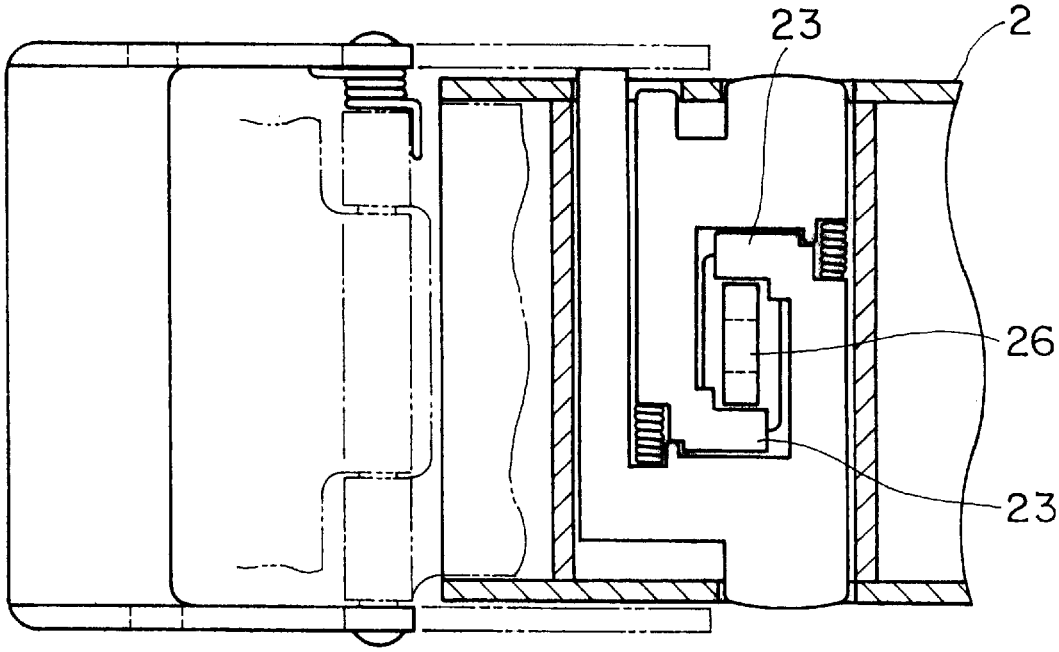
FIG. 19 is a sectional plan view showing the operation.

Only when the push button 16*b* is pushed, the lock cover can be opened as shown in FIG. 18. In the condition that the lock cover 30 is opened, when the push buttons 16*b* and 16*c* are pushed as shown in FIG. 19, the hooks 23 are removed from the lock pin 26. Thus, the surface cover 2 can be opened.

In accordance with the fourth embodiment, only when a particular push button is pushed, the lock cover can be opened. Therefore, the safety of the buckle is more ensured.

In the embodiment, if the operating push button 16*b* is colored with a color other than that of the push button 16*c*, for example with gold, it is possible to prevent miss operation of the push button.

Figure 20:
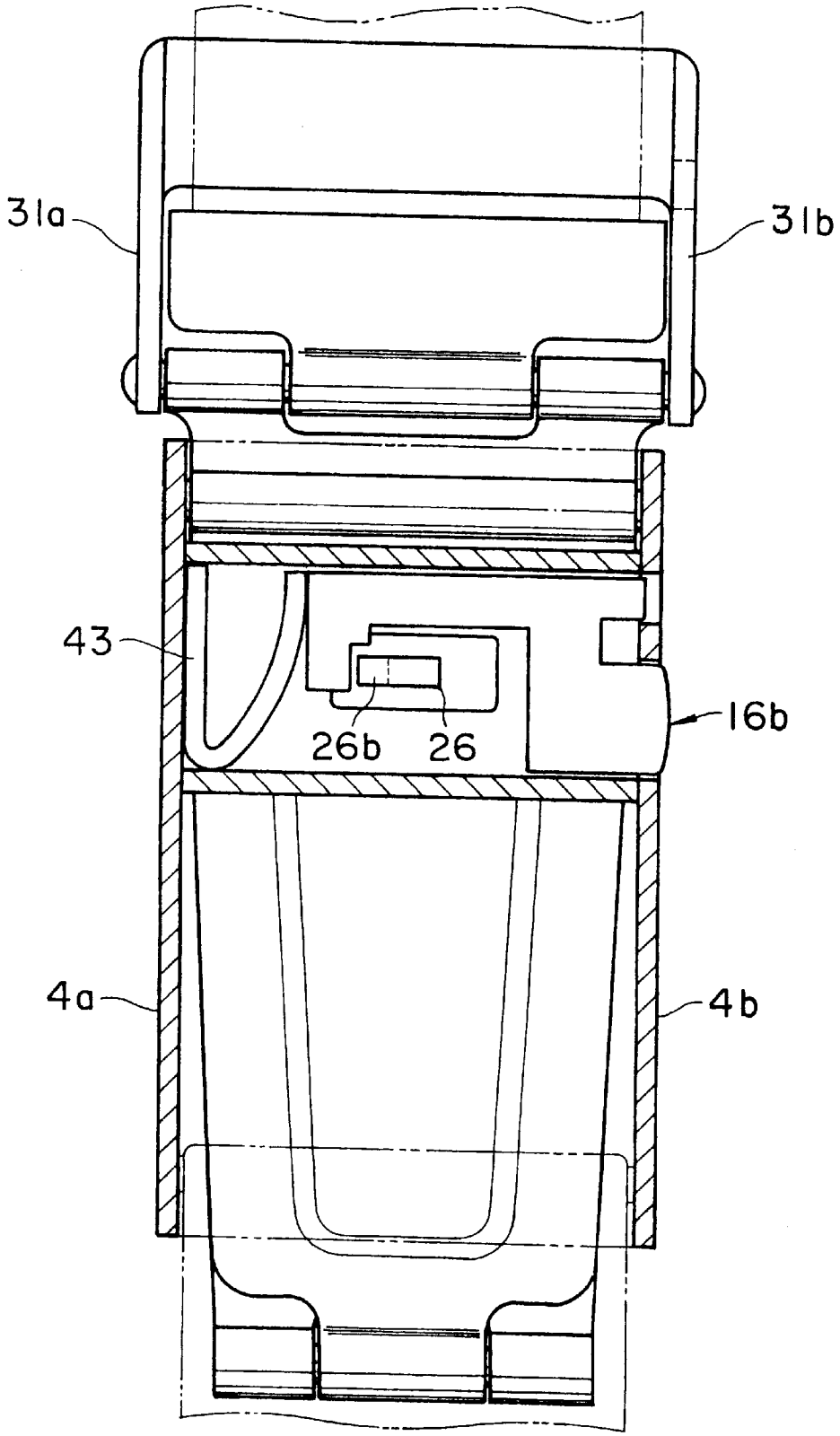
FIG. 20 is a sectional view showing a fifth embodiment of the present invention.

FIG. 20 shows the fifth embodiment of the present invention. In the embodiment, only one push button 16*b* is provided. Between the push button 16*b* and the side wall 4*a*, a plate spring 43 is disposed. Furthermore, the lock pin 26 having only one engaging portion 26*b* is provided for the push button 16*b*.

Figure 21:
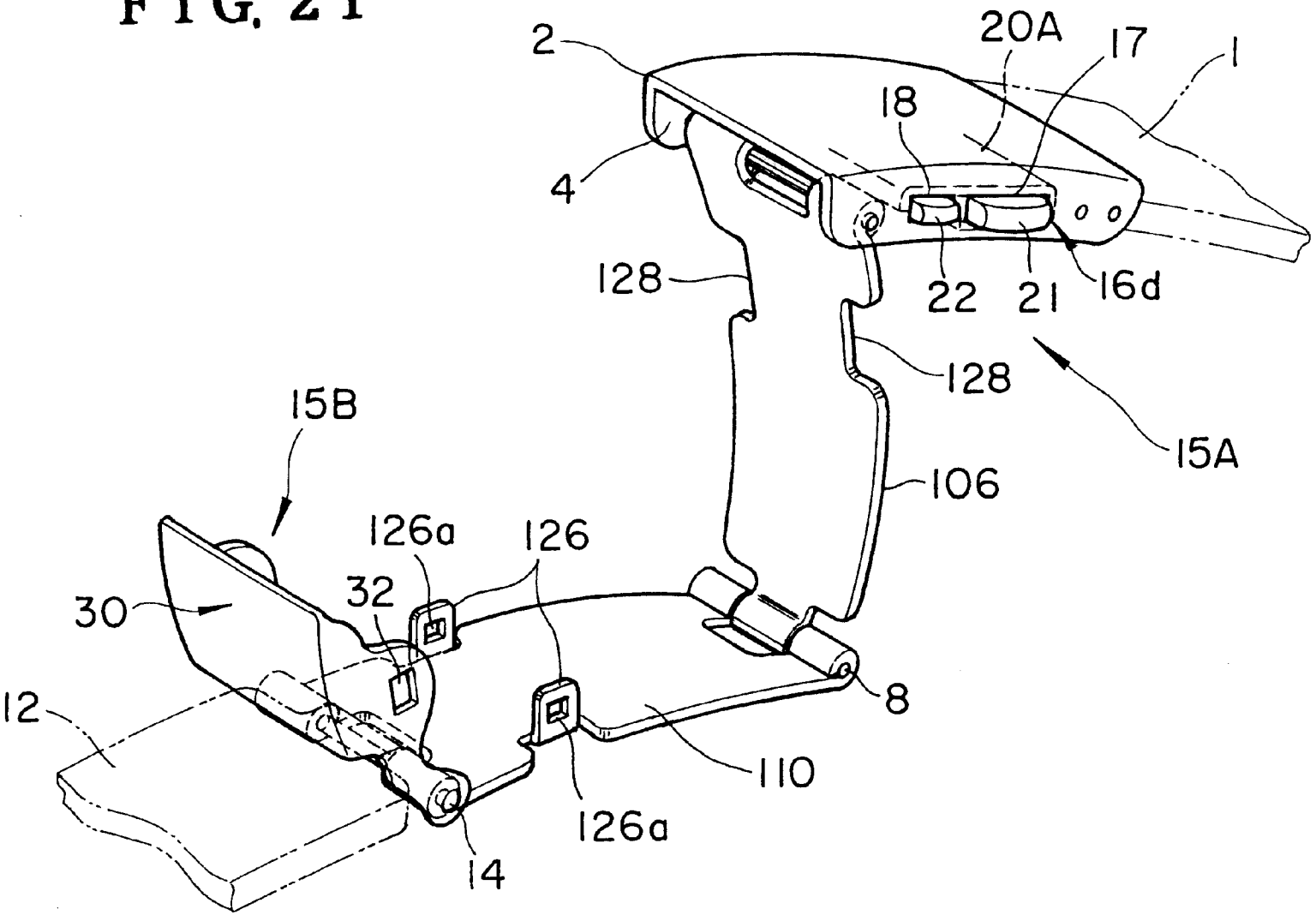
FIG. 21 is a perspective view showing a sixth embodiment of the present invention.
Figure 22:
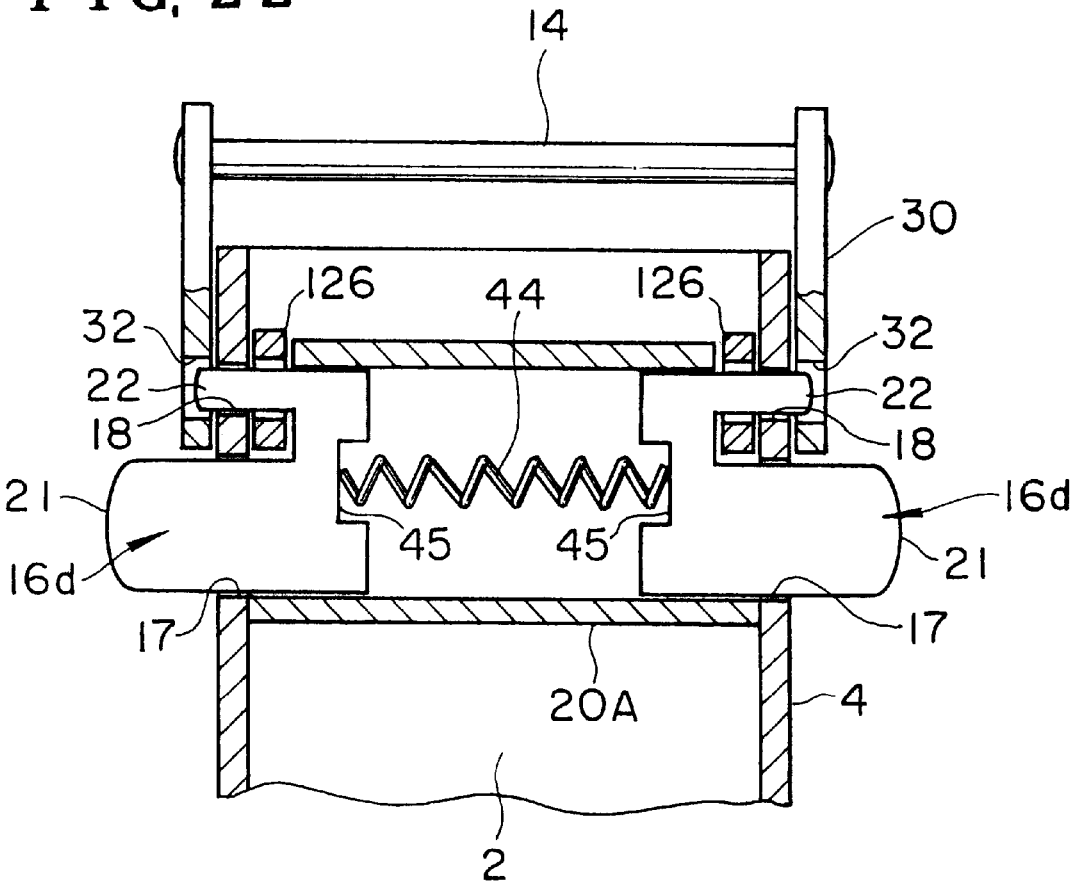
FIG. 22 is a sectional plan view of a part of the embodiment.
Figure 23:
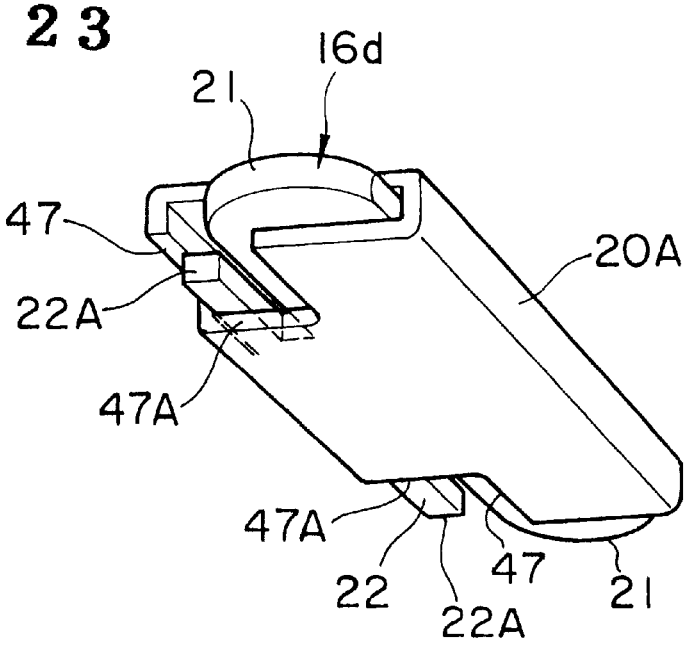
FIG. 23 is a perspective view of a guide housing as viewed from the underside thereof.

FIGS. 21 to 23 show the sixth embodiment of the present invention.

As shown in FIG. 21, the triple-folded buckle has the surface cover 2, a middle plate 106 and a lower plate 110.

The first lock device 15A has a guide housing 20A surrounding the openings 17 and 18, a pair of push buttons 16*d* slidably mounted in the guide housing 20A, and a spring 44 provided between the push buttons 16*d* for outwardly urging the push buttons. The push buttons have a line symmetry shape. Each push button 16*d* has the operating projection 21 projecting from the opening 17, engaging projection 22 projected from the opening 18, and recess 45 for receiving the spring 44.

Referring to FIG. 21, the lower plate 110 has a pair of engaging plates 126 upwardly projecting from the opposite both sides. Each engaging plate 126 has an engaging hole 126*a* which is adapted to be engaged with the engaging projection 22. On the other hand, in lower portions of the guide housing 20A and both sides of the middle plate 106, formed are recesses 47A and 128, each of which is provided to allow the engaging plate 126 to pass through there.

In order to wear the watch, the first and second lock devices 15A and 15*b* are released similarly to the first embodiment. The buckle is opened and the band is expanded so that the watch is put on the arm of the user. Next, each push button 16*d* is pushed until an end surface 22A of the projection 22 reaches the inside wall of engaging plate 126. In such a condition, the surface cover 2 and middle plate 106 are folded, and each push button 16*d* is released. Thus, each engaging projection 22 engages with the engaging hole 126*a* of the engaging plate 126 and the opening 18 of the surface cover 2, thereby causing the first lock device 15A to become the locking state.

The second lock device 15B is operated in the same manner as the first embodiment.

In the embodiment, the lock pin 26 of the previous embodiment is not provided. Instead, only the engaging projection 22 locks the first and second lock devices 15A and 15B.

Figure 24:
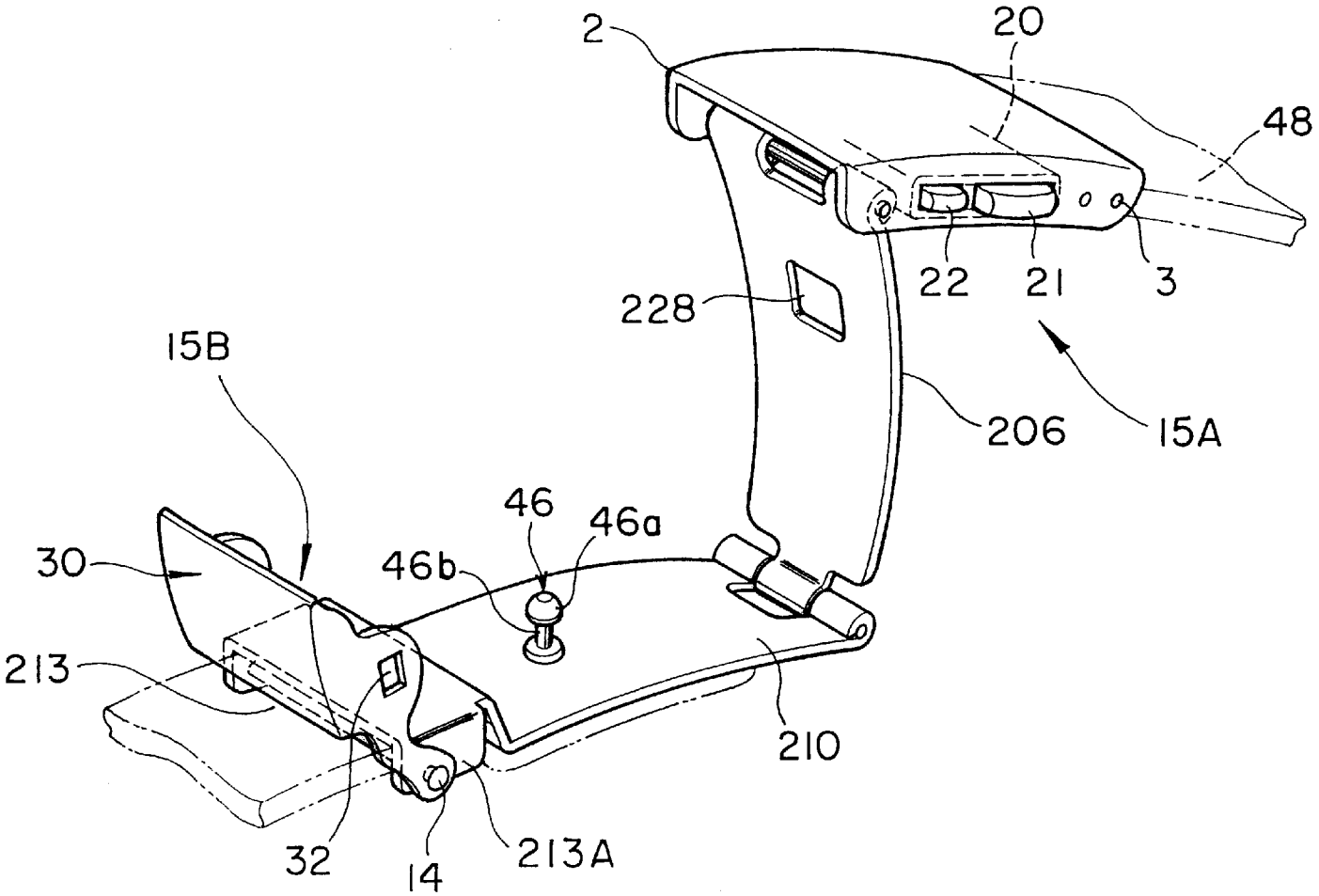
FIG. 24 is a perspective view of a seventh embodiment of the present invention.
Figure 25:
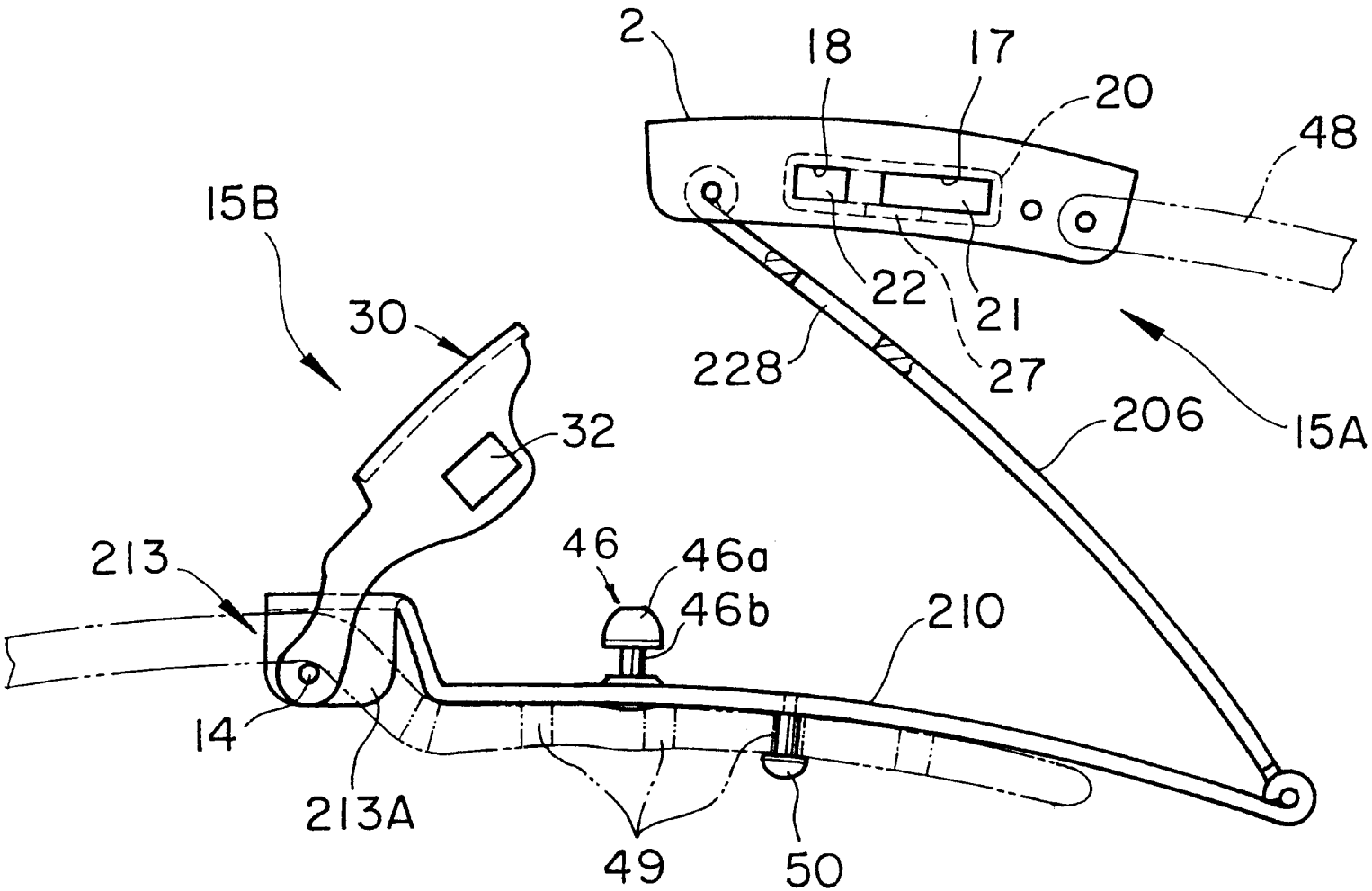
FIG. 25 is a sectional plan view thereof.
Figure 26:
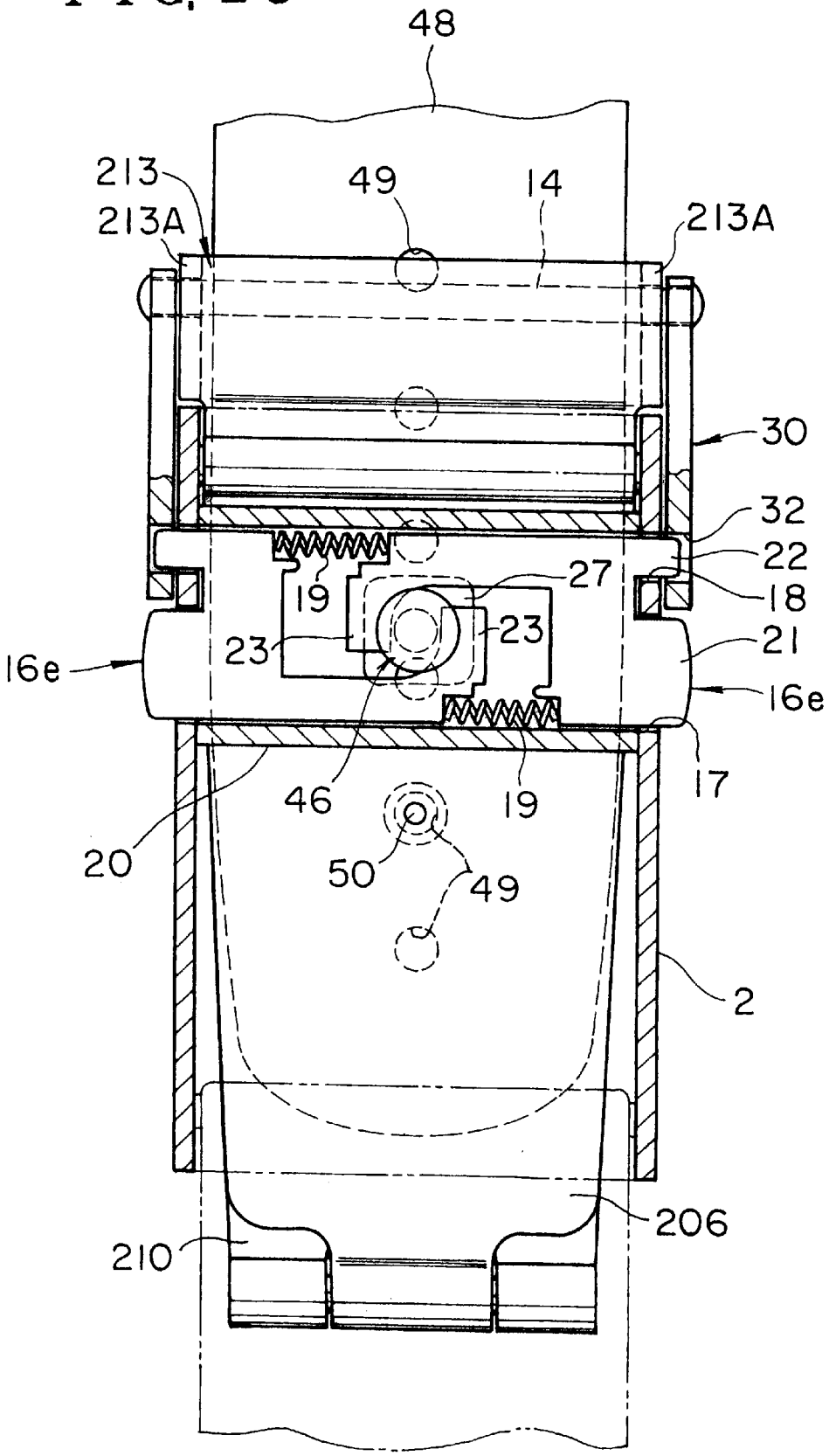
FIG. 26 is a side view thereof.

FIGS. 24 to 26 show the seventh embodiment of the present invention.

The embodiment is provided for a triple-folded buckle for a leather band. The buckle comprises the surface cover 2, a middle plate 206, and a lower plate 210. A leather band 48 is connected to the surface cover 2 by the spring-loaded pin 3 at an end, and a plurality of adjusting holes 49 are formed at another end portion. The lower plate 210 is stepwisely formed at a base end portion and a pair of side plate 213A are formed on opposite sides of the base end portion. A band passing opening 213 is formed by the side plates 213A and the pin 14. On the underside of the lower plate, an engaging pin 50 is mounted so as to be engaged with one of the adjusting holes 49.

On the upper surface of the lower plate 210, a lock pin 46 having a semispherical head 46*a* and a shaft portion 46*b* is secured. The middle plate 206 has an opening 228 through which the lock pin 46 passes.

In order to wear the watch, the first and second lock devices 15A and 15B are released. The buckle is opened and the band is expanded so that the watch is put on the arm of the user. Next, each push button 16*e* is pushed, and the surface cover 2 and middle plate 206 are folded. When the hooks 23 of the push buttons 16*e* pass the head 46*a* of the lock pin 46, the hooks engage hole 126*a* with the head. Thus, the first lock device 15A becomes a locking state. The second lock device 15B is operated in the same manner as the first embodiment. It is preferable to adjust the length of the band by the engaging pin 50 after the wearing of the watch.

Figure 27:
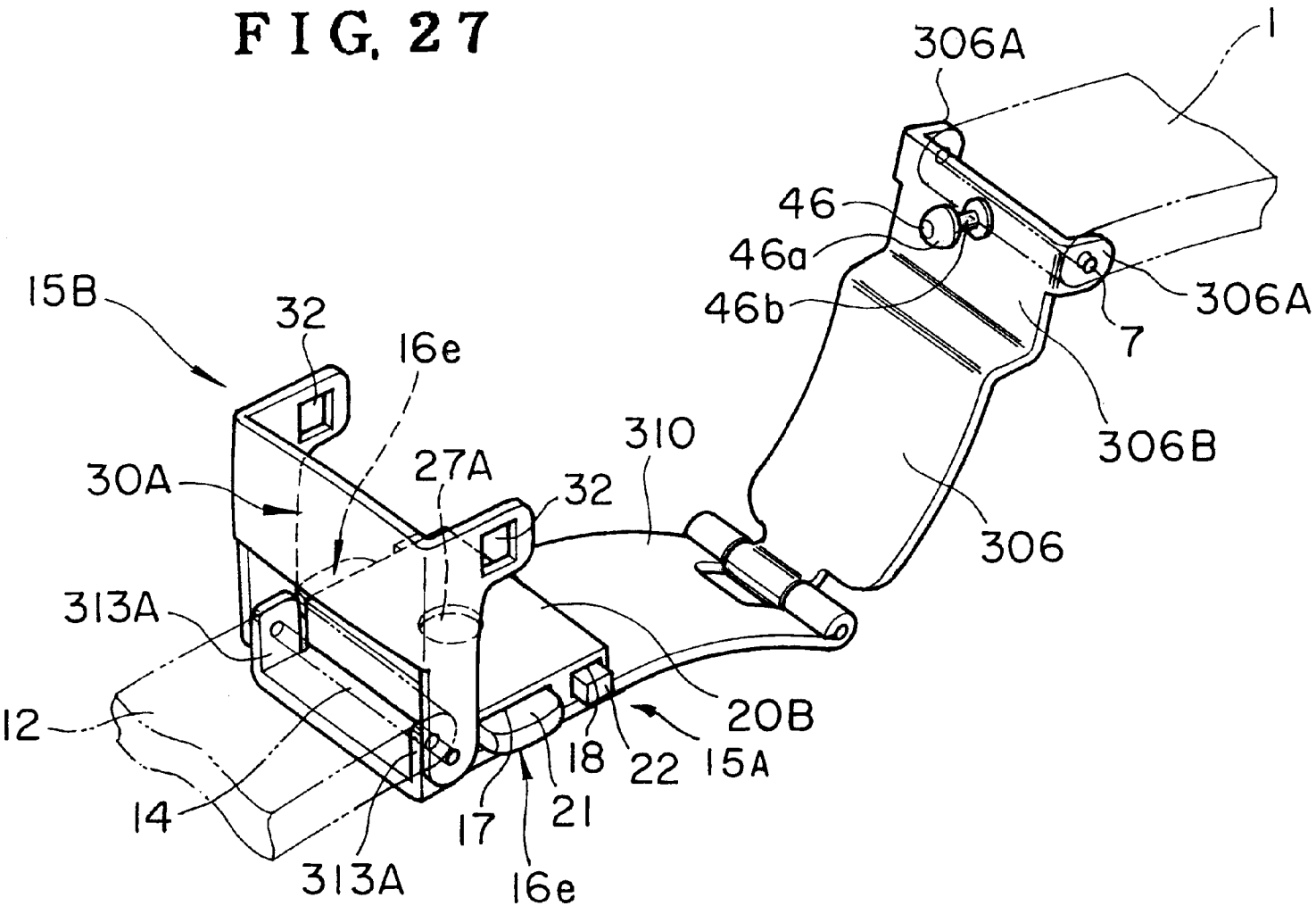
FIG. 27 is a perspective view of an eighth embodiment of the present invention.
Figure 28:
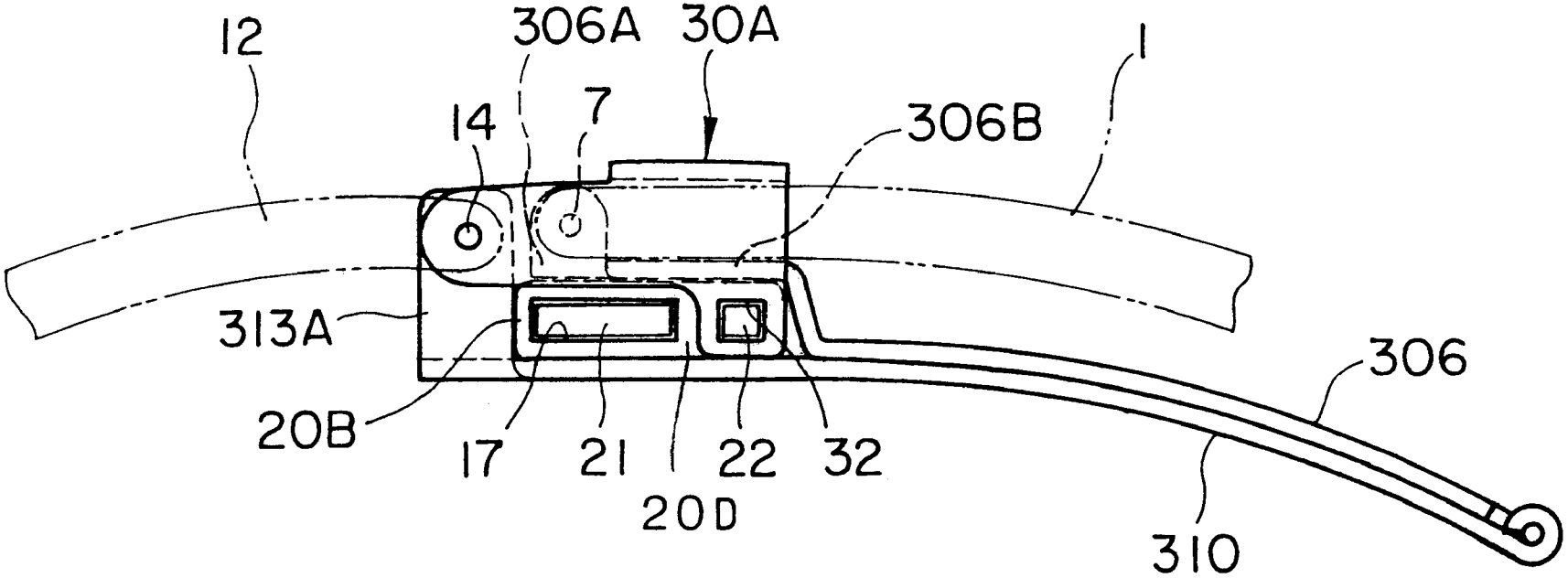
FIG. 28 is a side view where the buckle is locked.

FIGS. 27 and 28 show the eighth embodiment of the present invention.

The embodiment relates to a double-holded buckle, and hence the buckle comprises a middle plate 306 and a lower plate 310 without a surface cover.

A guide housing 20B is securely mounted on a base portion of the lower plate 310. An offset portion 306B is formed at an end portion of the middle plate 306 so as to cover the guide housing 20B when folded. A pair of side plates 306A are provided at both sides of the offset portion 306B. The band 1 is connected to the side plates 306A by the pin 7. The lock pin 46 is fixed to the offset portion 306B.

A pair of side plates 313A are formed at a base portion of the lower plate 310. The band 12 and a lock cover 30A of the second lock device 15B are rotatably connected to the side plates 313A by the pin 14. The guide housing 20B has an opening 27A in the upper plate, through which the lock pin 46 passes, and openings 17 and 18 at both side walls 200.

When the middle plate 306 is rotated to the lower plate 310, push buttons 16*e* are outwardly moved by the head 46*a* of the lock pin 46, and the head and the push buttons are engaged.

Next, when the lock cover 30A is rotated to the offset portion 306B, engaging holes 32 are engaged with the projections 22, thereby locking the buckle.

Figure 29:
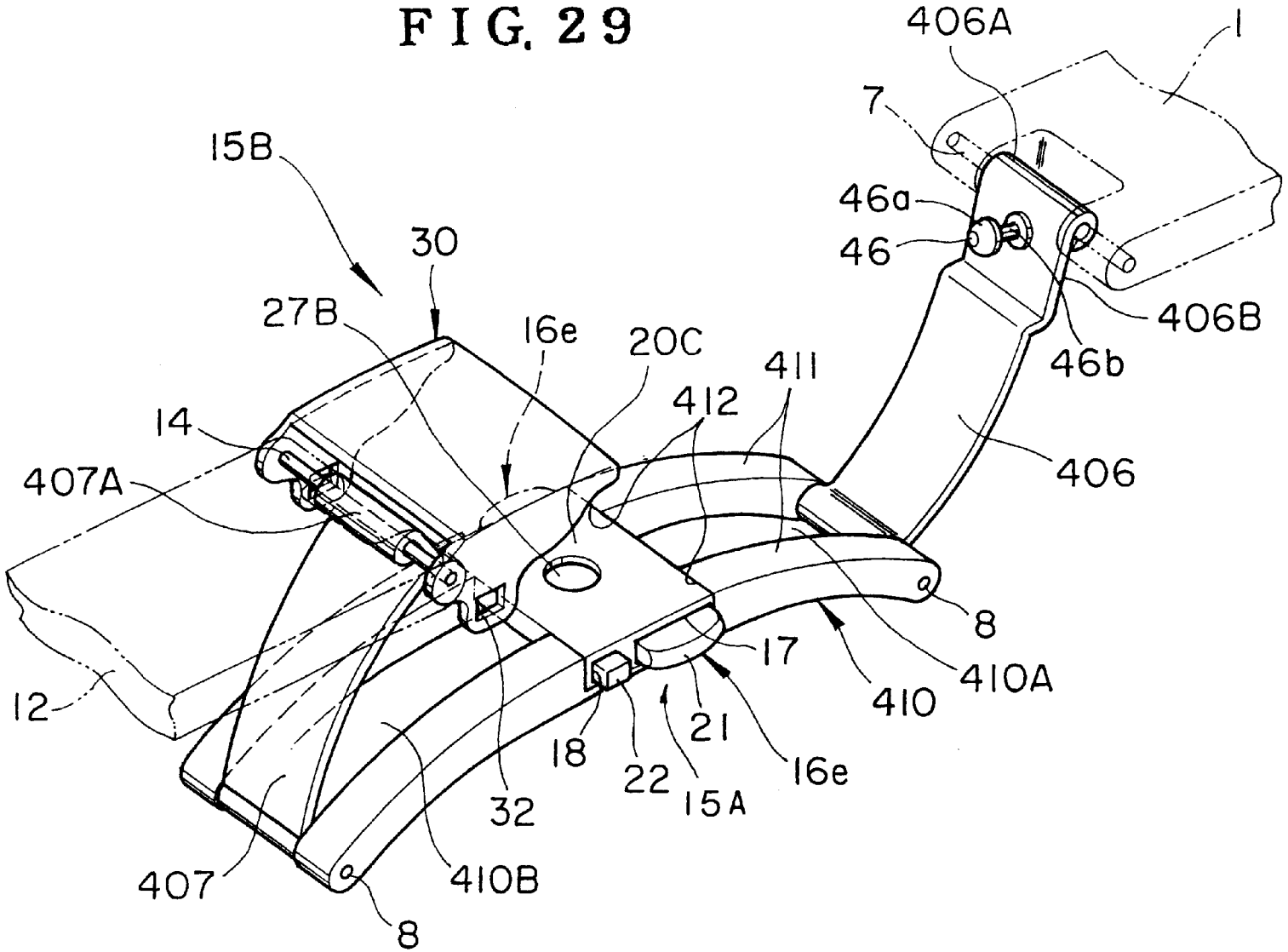
FIG. 29 is a perspective view of a ninth embodiment of the present invention.
Figure 30:
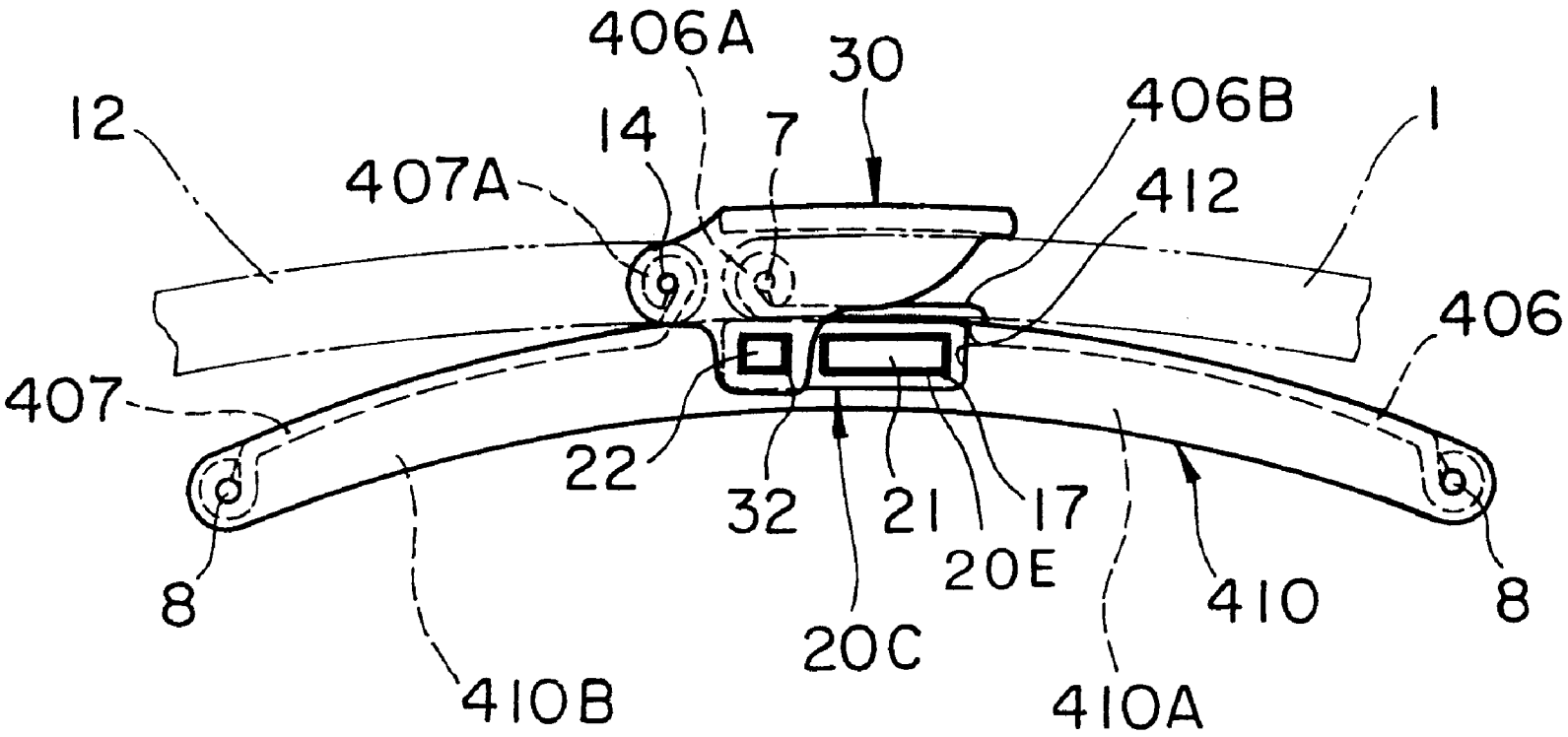
FIG. 30 is a side view where the buckle is locked.

FIGS. 29 and 30 show the ninth embodiment of the present invention.

In the embodiment, the present invention is applied to an oppositely opened buckle.

The buckle comprises opposite middle plates, that is a first middle plate 406 and a second middle plate 407, and a lower plate 410. The first middle plate 406 has a connecting portion 406*a* and an offset portion 406B corresponding to a guide housing 200. The band 1 is connected to the connecting portion 406A by the pin 7. The lock pin 46 is secured to the offset portion 406B. The first middle plate is connected to the lower plate by the pin 8.

The band 12 and the lock cover 30 are connected to a connecting portion 407A of the second middle plate 407 by the pin 14. The second middle plate 407 is connected to the lower plate 410 by the pin 8.

The lower plate 410 comprises a pair of lower plate members 411, each having a recess 412. A guide housing 20C of the first lock device 15A is secured to the recesses 412. The upper plate of the guide housing 20C has an opening 27B for the lock pin 46.

In order to wear the watch, the first and second middle plates are opened to expand the buckle. When the first middle plate 406 is rotated to the lower plate 410, the lock pin 46 is locked by the push buttons 16*e*. At that time, the first middle plate 406 is admitted in a space 410A between the members 411.

The second middle plate 407 is rotated to be admitted in a space 410B. The lock cover 30 is rotated to the offset portion 406B so that engaging holes 32 engage with the projections 22, thereby completely locking the buckle.

Although the guide housing is independently provided for guiding the push buttons in the above described embodiments, the guide housing may be formed by the middle plate as shown in Japanese Patent Laid Open 8-316.

Furthermore, instead of the hook and lock pin, a lock member is provided so as to be moved by the push buttons so that the lock member engages with a hole formed in the surface cover as described in Japanese Patent Laid Open 9-320.

PROBABILITY OF INDUSTRIAL EXPLOITATION

In accordance with the present invention, engaging projection is provided in each of the inherently provided push buttons, and the hole formed in the lock cover of the second lock device is formed so as to be engaged with the engaging projection. Therefore, since a specific pin and a space are not necessary, the construction is simplified and reduced in size, and the buckle can be manufactured at a low cost.

We claim:

1. A lock device for a buckle of a personal adornment band, the buckle having a first middle plate operatively connected to an end of a first band, and a lower plate rotatably connected to the first middle plate and operatively connected to a second band, the lock device comprising:

a first lock device; and a second lock device;

wherein the first lock device comprises a guide housing provided in the buckle, at lest one push button having an engaging portion and slidably mounted in the guide housing, a spring for outwardly urging the push button, and lock means adapted to be engaged with the push button; and the second lock device comprises a lock cover operatively connected to the lower plate at an end thereof, and engaging means for engaging the lock cover with the push button to hold the lock cover at a closing position wherein the lock cover is positioned above the first middle plate, thereby preventing the first middle plate from opening.

2. The lock device according to claim 1 wherein the first middle plate is connected to the first band through a surface cover.

3. The lock device according to claim 2 wherein the engaging portion has an engaging projection, and the lock means is an opening formed in the lower plate so as to be engaged with the engaging projection.

4. The lock device according to claim 3 wherein the engaging projection is provided to be further engaged with an engaging hole formed in the lock cover.

5. The lock device according to claim 4 wherein the push plate comprises a first push button and a second push button, the engaging projection is formed in the first push button, an engaging plate is formed in the second push button so as to extend in the projecting direction of the engaging projection, the second push button is so provided that the engaging plate is engaged with the engaging hole of the lock cover when pushed.

6. The lock device according to claim 4 wherein the engaging hole which is engaged with the engaging projection of the push button is formed in a side wall of the lock cover.

7. The lock device according to claim 1 wherein the engaging portion is a hook formed in the push button, and the lock means is a lock pin to be engaged with the hook.

8. The lock device according to claim 1 further comprising a torsion spring provided for urging the lock cover to an open direction.

9. A lock device for a buckle of a personal adornment band, the buckle having a first middle plate operatively connected to an end of a first band through a surface cover, and a lower plate rotatably connected to the first middle plate and operatively connected to a second band, the lock device comprising:

a first lock device; and a second lock device;

wherein the first lock device comprises a guide housing provided in the buckle, at lest one push button having an engacting portion and slidably mounted in the guide housing, a spring for outwardly urging the push button, and lock means adapted to be engaged with the push button; and the second lock device comprises a lock cover operatively connected to the lower plate at an end thereof, and engaging means for engaging the lock cover with the push button to hold the lock cover at a closings position wherein the engaging means comprises an engaging projection formed in the push button and provided to be projected from an opening formed in a side wall of the surface cover, and an engaging hole formed in the lock cover so as to be engaged with the engaging projection.

10. The lock device according to claim 9 wherein the lock cover is provided to be released by opening thereof.

11. The lock device according to claim 10 wherein if the moving distance of the push button is L, and the moving distance for releasing the hook of the push button is M, L<M.

12. The lock device according to claim 11 wherein the push button comprises a pair of push buttons, one of the push button has a projection for determining the moving distance M by abutting against the other push button.

13. The lock device according to claim 9 wherein the push button comprises a first push button and a second push button, the engaging projection is formed in the first push button, the lock cover is provided to be released by pushing the first push button.

14. The lock device according to claim 13 wherein the first push button is colored with different color from the second push button.

* * * * *